US012584665B2

(12) United States Patent
Wang et al.

(10) Patent No.: US 12,584,665 B2
(45) Date of Patent: Mar. 24, 2026

(54) METHOD AND DEVICE FOR CONTROLLING AIR CONDITIONER

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Xinli Wang, Foshan (CN); Xihua Ma, Foshan (CN); Mingren Wang, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 188 days.

(21) Appl. No.: 18/550,464

(22) PCT Filed: Sep. 18, 2021

(86) PCT No.: PCT/CN2021/119456
§ 371 (c)(1),
(2) Date: Sep. 14, 2023

(87) PCT Pub. No.: WO2022/193596
PCT Pub. Date: Sep. 22, 2022

(65) Prior Publication Data

US 2024/0159437 A1 May 16, 2024

(30) Foreign Application Priority Data

Mar. 15, 2021 (CN) ..... 202110277853.X

(51) Int. Cl.
*F25B 47/02* (2006.01)
*F24F 11/65* (2018.01)
*F25B 41/26* (2021.01)

(52) U.S. Cl.
CPC ..... *F25B 47/02* (2013.01); *F24F 11/65* (2018.01); *F25B 41/26* (2021.01);
(Continued)

(58) Field of Classification Search
CPC ..... F25B 47/02; F25B 11/65; F25B 41/26; F25B 2313/0292; F25B 2347/02; F25B 2400/04; F25B 2313/02742
See application file for complete search history.

(56) References Cited

U.S. PATENT DOCUMENTS

2013/0145785 A1 6/2013 Nobuhiro
2016/0003499 A1* 1/2016 Park ..... F25B 13/00 62/115

(Continued)

FOREIGN PATENT DOCUMENTS

CN 103807997 A 5/2014
CN 104515210 A 4/2015

(Continued)

OTHER PUBLICATIONS

International Search Report received in PCT/CN2021/119456; mailed Nov. 19, 2021.

(Continued)

*Primary Examiner* — David J Teitelbaum
(74) *Attorney, Agent, or Firm* — K&L Gates LLP

(57) ABSTRACT

Disclosed are a method and device for controlling an air conditioner. The air conditioner includes an outdoor heat exchanger, an indoor heat exchanger, a heat storage heat exchanger, a compressor, a four-way valve assembly, and a throttling assembly, wherein the outdoor heat exchanger is (Continued)

connected to the indoor heat exchanger by means of a first pipeline and a bypass, the outdoor heat exchanger is connected to the compressor by means of a second pipeline, the indoor heat exchanger is connected to the compressor by means of a third pipeline, the heat storage heat exchanger is arranged on the bypass, the throttling assembly is arranged on the bypass, the four-way valve assembly includes a first four-way valve and a second four-way valve, the first four-way valve is arranged on the second pipeline, and the second four-way valve is arranged on the third pipeline.

17 Claims, 9 Drawing Sheets

(52) U.S. Cl.
CPC ... *F25B 2313/0292* (2013.01); *F25B 2347/02* (2013.01); *F25B 2400/04* (2013.01)

(56) References Cited

U.S. PATENT DOCUMENTS

2018/0017293 A1* 1/2018 Naito ..... F25B 13/00
2019/0011148 A1* 1/2019 Matsuda ..... F25B 13/00
2019/0383532 A1* 12/2019 Mizutani ..... F25B 6/00
2021/0215403 A1* 7/2021 Feng ..... F25B 47/02
2022/0357085 A1* 11/2022 Sato ..... F24F 11/41

FOREIGN PATENT DOCUMENTS

CN 104633836 A 5/2015
CN 104634009 A 5/2015
CN 104833060 A 8/2015
CN 105757827 A 7/2016
CN 109405335 A 3/2019
JP 2000179970 A 6/2000
JP 2001263848 A 9/2001

OTHER PUBLICATIONS

First Office Action received in CN application 202110277853.X; mailed Aug. 4, 2023.
Search Report received in EP Application No. 21931171.9; mailed Apr. 9, 2024.
Second OA received in CN application No. 202110277853.X; mailed Mar. 3, 2024.

* cited by examiner

METHOD AND DEVICE FOR CONTROLLING AIR CONDITIONER

CROSS-REFERENCES TO RELATED APPLICATIONS

The present disclosure is a national phase application of International Application No. PCT/CN2021/119456, filed on Sep. 18, 2021, which claims priority to and benefits of the Chinese Patent Application No. "202110277853.X" filed on Mar. 15, 2021, the entireties of which are herein incorporated by reference.

FIELD

The present disclosure relates to the field of an air conditioner technology, particularly relates to a method and device for controlling an air conditioner, an air conditioner, an electronic device and a computer readable storage medium.

BACKGROUND

At present, with the improvement of people's living standard, an air conditioner has also been on an increasing comfort requirement. In the related art, it is prone for an outdoor unit to frost in a heating mode serving as an evaporator; while during a defrosting process, an indoor unit is converted to serve as the evaporator and the outdoor unit is converted to serve as a condenser to absorb heat from indoor for defrosting the outdoor unit, resulting in poor heating performance of the indoor unit, thus adversely affecting the user's experience.

SUMMARY

The present disclosure aims to solve at least one of the problems in the related art to a certain degree.

One embodiment of the present disclosure is to propose a method for controlling an air conditioner, which identifies an operation mode of the air conditioner; controls the first four-way valve and the second four-way valve both to be powered on in response to the operation mode of the air conditioner being a heating mode; and controls the first four-way valve to be powered off and the second four-way valve to be powered on in response to the operation mode of the air conditioner being a defrosting mode. Accordingly, when the operation mode of the air conditioner is the defrosting mode, the outdoor heat exchanger and the indoor heat exchanger each serve as a condenser, while the heat storage heat exchanger serves as an evaporator, and heat is absorbed from the heat storage heat exchanger for defrosting the outdoor heat exchanger without adversely affecting the heating performance of the indoor heat exchanger, to improve the air conditioner for comfort and user's experience.

Another embodiment of the present disclosure is to propose a device for controlling an air conditioner.

One embodiment of the present disclosure is to provide an air conditioner.

In yet another embodiment of the present disclosure is to provide an electronic device.

In one embodiment of the present disclosure is to provide a computer readable storage medium.

Embodiments of the present disclosure provides in an embodiment a method for controlling an air conditioner, and the air conditioner includes an outdoor heat exchanger, an indoor heat exchanger, a heat storage heat exchanger, a compressor, a four-way valve assembly, and a throttling assembly, the outdoor heat exchanger is connected to the indoor heat exchanger through either a first pipeline or a bypass, the outdoor heat exchanger is connected to the compressor through a second pipeline, the indoor heat exchanger is connected to the compressor through a third pipeline, and the heat storage heat exchanger is arranged at the bypass, the throttling assembly is arranged at the bypass, the four-way valve assembly includes a first four-way valve and a second four-way valve, the first four-way valve is arranged at the second pipeline, the second four-way valve is arranged at the third pipeline, the method for controlling the air conditioner includes: identifying an operation mode of the air conditioner; controlling the first four-way valve and the second four-way valve both to be powered on in response to the operation mode of the air conditioner being a heating mode; and controlling the first four-way valve to be powered off and the second four-way valve to be powered on in response to the operation mode of the air conditioner being a defrosting mode.

According to an embodiment of the present disclosure, the method for controlling the air conditioner identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as a condenser, while the heat storage heat exchanger serves as an evaporator, and heat is absorbed from the heat storage heat exchanger for defrosting the outdoor heat exchanger without adversely affecting the heating performance of the indoor heat exchanger, to improve the air conditioner for comfort and user's experience.

In addition, the method for controlling the air conditioner proposed according to the above embodiment of the present disclosure may further include the following additional embodiments.

In an embodiment of the present disclosure, after controlling the first four-way valve to be powered off and the second four-way valve to be powered on, the method further includes: controlling the first four-way valve and the second four-way valve both to be powered on, in response to identifying that the outdoor heat exchanger is of a first pipe-wall temperature higher than or equal to a first preset temperature and/or that a defrosting duration reaches a first preset duration.

In an embodiment of the present disclosure, the method further includes: determining whether the air conditioner is in a target operation state, and the target operation state includes a heating target operation state and a cooling target operation state; and controlling the throttling assembly to switch on in response to the air conditioner being in the target operation state, or controlling the throttling assembly to switch off in response to the air conditioner being out of the target operation state.

In an embodiment of the present disclosure, determining whether the air conditioner is in the target operation state includes: determining that the air conditioner is in the target operation state, in response to identifying that the air conditioner is of a heating capacity demand parameter or a cooling capacity demand parameter lower than or equal to a first preset threshold for a second preset duration; or determining that the air conditioner is out of the target operation state, in response to identifying that the air conditioner is of a heating capacity demand parameter or a cooling capacity demand parameter greater than or equal to a second preset threshold for a third preset duration.

In an embodiment of the present disclosure, the air conditioner includes the indoor heat exchangers, and determining whether the air conditioner is in the target operation state further includes: based on that the operation mode of the air conditioner is a mixed mode, and the mixed mode includes the heating mode for at least one of the indoor heat exchangers and a cooling mode for at least one of the indoor heat exchangers, acquiring a heating capacity demand parameter and a cooling capacity demand parameter; determining that the air conditioner is in the heating target operation state, in response to identifying that the heating capacity demand parameter is lower than or equal to the cooling capacity demand parameter, or determining that the air conditioner is in the cooling target operation state, in response to identifying that the heating capacity demand parameter is greater than the cooling capacity demand parameter.

In an embodiment of the present disclosure, prior to controlling the throttling assembly to switch on, the method further includes: identifying that the indoor heat exchanger is of a second pipe-wall temperature higher than or equal to a second preset temperature for a fourth preset duration in response to the air conditioner being in the heating target operation state; or identifying that the indoor heat exchanger is of a second pipe-wall temperature lower than or equal to a third preset temperature for a fifth preset duration in response to the air conditioner being in the cooling target operation state.

In an embodiment of the present disclosure, after controlling the throttling assembly to switch on, the method further includes: based on that the air conditioner is in the heating target operation state, controlling the first four-way valve to be powered off, in response to identifying that the heat storage heat exchanger is of an outlet pipe-wall temperature greater than or equal to a fourth preset temperature for a sixth preset duration; and controlling the first four-way valve to be powered on, and returning back to determine whether the air conditioner is in the target operation state and subsequent steps thereof, in response to identifying that the heat storage heat exchanger is of an inlet pipe-wall temperature lower than or equal to a fifth preset temperature and/or that the first four-way valve has been powered off for a seventh preset duration.

In an embodiment of the present disclosure, after controlling the throttling assembly to switch on, the method further includes: based on that the air conditioner is in the cooling target operation state, controlling the first four-way valve to be powered on, in response to identifying that the heat storage heat exchanger is of an outlet pipe-wall temperature lower than or equal to a sixth preset temperature for an eighth preset duration; and controlling the first four-way valve to be powered off, and returning back to determine whether the air conditioner is in the target operation state and subsequent steps thereof, in response to identifying that the heat storage heat exchanger is of an inlet pipe-wall temperature greater than or equal to a seventh preset temperature and/or that the first four-way valve has been powered on for a ninth preset duration.

In an embodiment of the present disclosure, the four-way valve assembly further includes a third four-way valve arranged at the bypass; the method further includes: controlling the third four-way valve to be powered off in response to the operation mode of the air conditioner being the heating mode; and controlling the third four-way valve to be powered on in response to the operation mode of the air conditioner being the defrosting mode.

In an embodiment of the present disclosure, the method further includes: controlling the first four-way valve and the second four-way valve both to be powered off and the third four-way valve to be powered on, in response to the operation mode of the air conditioner being the cooling mode.

Embodiments of the present disclosure provides in an embodiment a device for controlling an air conditioner, the air conditioner includes an outdoor heat exchanger, an indoor heat exchanger, a heat storage heat exchanger, a compressor, a four-way valve assembly, and a throttling assembly, the outdoor heat exchanger is connected to the indoor heat exchanger through either a first pipeline or a bypass, the outdoor heat exchanger is connected to the compressor through a second pipeline, the indoor heat exchanger is connected to the compressor through a third pipeline, and the heat storage heat exchanger is arranged at the bypass, the throttling assembly is arranged at the bypass, the four-way valve assembly includes a first four-way valve and a second four-way valve, the first four-way valve is arranged at the second pipeline, the second four-way valve is arranged at the third pipeline, the device for controlling the air conditioner includes: an identifying device, configured to identify an operation mode of the air conditioner; and a responding device, configured to control the first four-way valve and the second four-way valve both to be powered on in response to the operation mode of the air conditioner being a heating mode; and control the first four-way valve to be powered off and the second four-way valve to be powered on in response to the operation mode of the air conditioner being a defrosting mode.

According to an embodiment of the present disclosure, the device for controlling the air conditioner identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as a condenser, while the heat storage heat exchanger serves as an evaporator, and heat is absorbed from the heat storage heat exchanger for defrosting the outdoor heat exchanger without adversely affecting the heating performance of the indoor heat exchanger, to improve the air conditioner for comfort and user's experience.

In addition, the device for controlling the air conditioner proposed according to the above embodiment of the present disclosure may further include the following additional embodiments.

In an embodiment of the present disclosure, the device for controlling the air conditioner further includes a control device, and after the first four-way valve is controlled to be powered off and the second four-way valve is controlled to be powered on, the controlling device is configured to control the first four-way valve and the second four-way valve both to be powered on, in response to identifying that the outdoor heat exchanger is of a first pipe-wall temperature higher than or equal to a first preset temperature and/or that a defrosting duration reaches a first preset duration.

In an embodiment of the present disclosure, the device for controlling the air conditioner further includes a determining device, configured to determine whether the air conditioner is in a target operation state, and the target operation state includes a heating target operation state and a cooling target operation state; and the responding device is further configured to control the throttling assembly to switch on in response to the air conditioner being in the target operation state, or control the throttling assembly to switch off in response to the air conditioner being out of the target operation state.

In an embodiment of the present disclosure, the determining device is configured to determine that the air conditioner is in the target operation state, in response to identifying that the air conditioner is of a heating capacity demand parameter or a cooling capacity demand parameter lower than or equal to a first preset threshold for a second preset duration; or determine that the air conditioner is out of the target operation state, in response to identifying that the air conditioner is of a heating capacity demand parameter or a cooling capacity demand parameter greater than or equal to a second preset threshold for a third preset duration.

In an embodiment of the present disclosure, the air conditioner includes the indoor heat exchangers, and the determining device is configured to, based on that the operation mode of the air conditioner is a mixed mode, and the mixed mode includes the heating mode for at least one of the indoor heat exchangers and a cooling mode for at least one of the indoor heat exchangers, acquire a heating capacity demand parameter and a cooling capacity demand parameter; determine that the air conditioner is in the heating target operation state, in response to identifying that the heating capacity demand parameter is lower than or equal to the cooling capacity demand parameter, or determine that the air conditioner is in the cooling target operation state, in response to identifying that the heating capacity demand parameter is greater than the cooling capacity demand parameter.

In an embodiment of the present disclosure, before the throttling assembly is controlled to switch on, the responding device is further configured to identify that the indoor heat exchanger is of a second pipe-wall temperature higher than or equal to a second preset temperature for a fourth preset duration in response to the air conditioner being in the heating target operation state; or identify that the indoor heat exchanger is of a second pipe-wall temperature lower than or equal to a third preset temperature for a fifth preset duration in response to the air conditioner being in the cooling target operation state.

In an embodiment of the present disclosure, after the throttling assembly is controlled to switch on, the responding device is further configured to, based on that the air conditioner is in the heating target operation state, control the first four-way valve to be powered off, in response to identifying that the heat storage heat exchanger is of an outlet pipe-wall temperature greater than or equal to a fourth preset temperature for a sixth preset duration; and control the first four-way valve to be powered on, and return back to determine whether the air conditioner is in the target operation state and subsequent steps thereof, in response to identifying that the heat storage heat exchanger is of an inlet pipe-wall temperature lower than or equal to a fifth preset temperature and/or that the first four-way valve has been powered off for a seventh preset duration.

In an embodiment of the present disclosure, after the throttling assembly is controlled to switch on, the responding device is further configured to, based on that the air conditioner is in the cooling target operation state, control the first four-way valve to be powered on, in response to identifying that the heat storage heat exchanger is of an outlet pipe-wall temperature lower than or equal to a sixth preset temperature for an eighth preset duration; and control the first four-way valve to be powered off, and return back to determine whether the air conditioner is in the target operation state and subsequent steps thereof, in response to identifying that the heat storage heat exchanger is of an inlet pipe-wall temperature greater than or equal to a seventh preset temperature and/or that the first four-way valve has been powered on for a ninth preset duration.

In an embodiment of the present disclosure, the four-way valve assembly further includes a third four-way valve arranged at the bypass; and the responding device is further configured to control the third four-way valve to be powered off in response to the operation mode of the air conditioner being the heating mode; and control the third four-way valve to be powered on in response to the operation mode of the air conditioner being the defrosting mode.

In an embodiment of the present disclosure, the responding device is further configured to control the first four-way valve and the second four-way valve both to be powered off and the third four-way valve to be powered on, in response to the operation mode of the air conditioner being the cooling mode.

Embodiments of the present disclosure provides in an embodiment an air conditioner, including: an outdoor heat exchanger, an indoor heat exchanger, a heat storage heat exchanger, a compressor, a four-way valve assembly, and a throttling assembly, and the outdoor heat exchanger is connected to the indoor heat exchanger through either a first pipeline or a bypass, the outdoor heat exchanger is connected to the compressor through a second pipeline, the indoor heat exchanger is connected to the compressor through a third pipeline, and the heat storage heat exchanger is arranged at the bypass, the throttling assembly is arranged at the bypass, the four-way valve assembly includes a first four-way valve and a second four-way valve, the first four-way valve is arranged at the second pipeline, the second four-way valve is arranged at the third pipeline; and a device for controlling an air conditioner as described in embodiments of the present disclosure.

According to an embodiment of the present disclosure, the air conditioner identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as a condenser, while the heat storage heat exchanger serves as an evaporator, and heat is absorbed from the heat storage heat exchanger for defrosting the outdoor heat exchanger without adversely affecting the heating performance of the indoor heat exchanger, to improve the air conditioner for comfort and user's experience.

In addition, the air conditioner proposed according to the above embodiment of the present disclosure may further include the following additional embodiment.

In an embodiment of the present disclosure, the four-way valve assembly further includes a third four-way valve arranged at the bypass.

Embodiments of the present disclosure provides in an embodiment an electronic device, including a memory and a processor, and the processor runs a program corresponding to an executable program code by reading the executable program code stored in the memory, to implement a method for controlling an air conditioner as described in embodiments of the present disclosure.

According to an embodiment of the present disclosure, the electronic device, by means of the processor executing the computer program stored in the memory, identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as a condenser, while the heat storage heat exchanger serves as an evaporator, and heat is absorbed from the heat storage heat exchanger for defrosting the outdoor heat exchanger without adversely affecting the heating performance of the indoor heat exchanger, to improve the air conditioner for comfort and user's experience.

Embodiments of the present disclosure provides in an embodiment a computer readable storage medium having stored therein a computer program that, when executed by a processor, implements a method for controlling an air conditioner as described in embodiments of the present disclosure.

According to an embodiment of the present disclosure, the computer readable storage medium, by having stored therein the computer program that is executed by the processor, identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as a condenser, while the heat storage heat exchanger serves as an evaporator, and heat is absorbed from the heat storage heat exchanger for defrosting the outdoor heat exchanger without adversely affecting the heating performance of the indoor heat exchanger, to improve the air conditioner for comfort and user's experience.

The embodiments of the present disclosure will be partially provided in the following description, which will become apparent from the following description or learned through the practice of the present disclosure.

BRIEF DESCRIPTION OF THE DRAWINGS

The above and/or additional embodiments of the present disclosure will become understandable with the following description for embodiments in combination with the drawings, in which.

DETAILED DESCRIPTION OF THE DISCLOSURE

Figure 1:
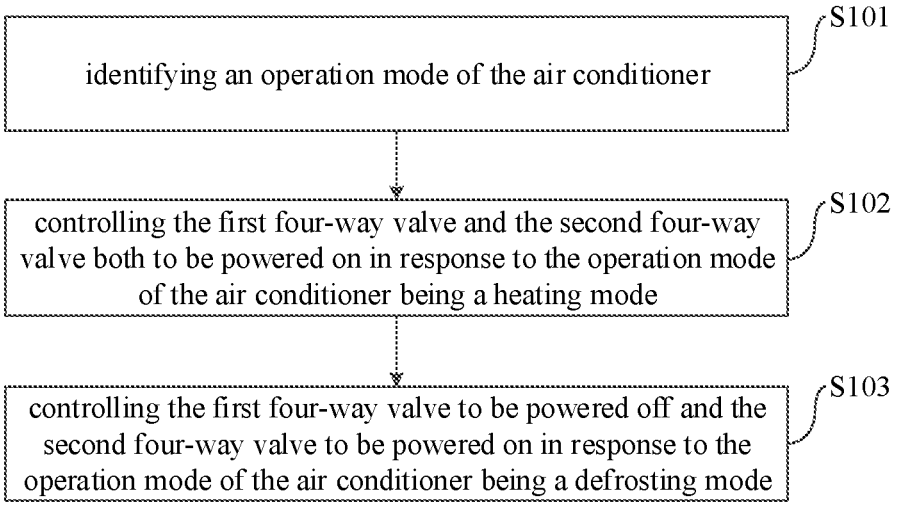
FIG. 1 is a flow chart showing a method for controlling an air conditioner according to an embodiment of the present disclosure.

Reference will be made in details to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

A method and device for controlling an air conditioner, an air conditioner, an electronic device and a computer readable storage medium in embodiments of the present disclosure are described below in combination with the drawings.

FIG. 1 is a flow chart showing a method for controlling an air conditioner according to an embodiment of the present disclosure.

Figure 2:
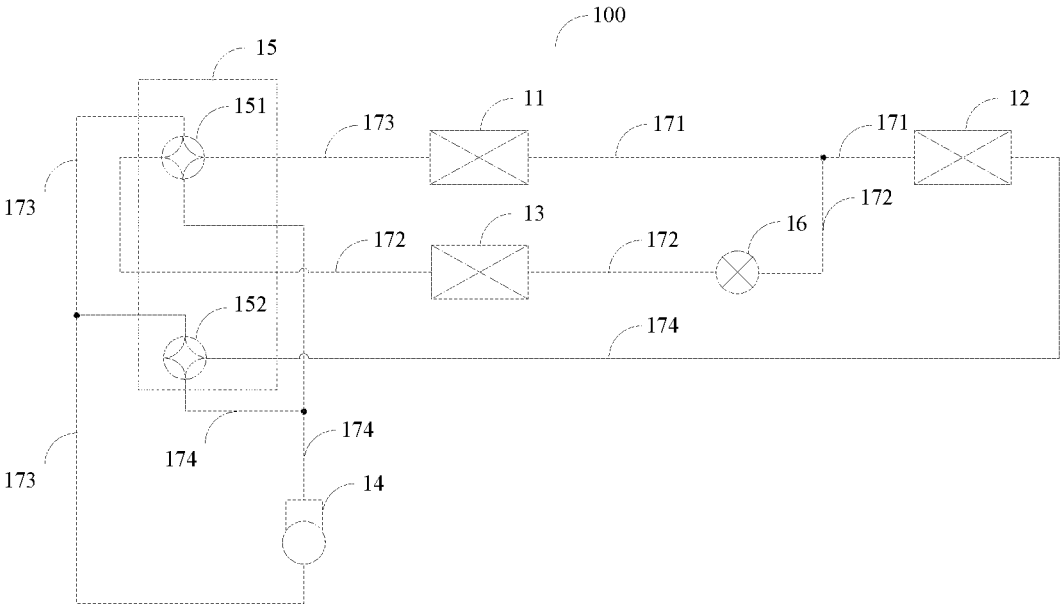
FIG. 2 is a schematic diagram showing a structure of an air conditioner according to an embodiment of the present disclosure.

It should note that, as shown in FIG. 2, in an embodiment of the present disclosure, the air conditioner includes the outdoor heat exchanger 11, the indoor heat exchanger 12, the heat storage heat exchanger 13, the compressor 14, the four-way valve assembly 15, and the throttling assembly 16. It should note that the air conditioner illustrated in FIG. 2 is merely an example of the air conditioner in an embodiment of the present disclosure, rather than limitation to the air conditioner in an embodiment of the present disclosure.

The outdoor heat exchanger 11 is connected to the indoor heat exchanger 12 through either the first pipeline 171 or the bypass 172; the outdoor heat exchanger 11 is connected to the compressor 14 through the second pipeline 173; and the indoor heat exchanger 12 is connected to the compressor 14 through the third pipeline 174. The heat storage heat exchanger 13 is arranged at the bypass 172, and the bypass 172 is provided with the throttling assembly 16. The four-way valve assembly 15 includes the first four-way valve 151 and the second four-way valve 152. The first four-way valve 151 is arranged at the second pipeline 173; and the second four-way valve 152 is arranged at the third pipeline 174. In one embodiment, the first pipeline 171 is provided with the throttling assembly 16.

In one embodiment, the first four-way valve 151 and the second four-way valve 152 each may be an electronic expansion valve.

As shown in FIG. 1, in an embodiment of the present disclosure, the method for controlling the air conditioner includes the following steps.

At S101, an operation mode of the air conditioner is identified.

It would be appreciated that the operation mode of the air conditioner may be set according to an actual situation. For example, a user may set the operation mode of the air conditioner in a flexible way. In one embodiment, the use may set the operation mode of the air conditioner by a remote controller, an Application (APP) for the air conditioner in a mobile terminal, or a control panel on a body of the air conditioner, or through a non-contact approach such as a language and a gesture.

Further, one may acquire a setting parameter with respect to the operation mode from the remote controller, the Application (APP) for the air conditioner in the mobile terminal, or the control panel on the body of the air conditioner, to identify the operating mode of the air conditioner.

At S102, in response to the operation mode of the air conditioner being a heating mode, the first four-way valve and the second four-way valve both are controlled to be powered on.

In an embodiment of the present disclosure, in response to the operation mode of the air conditioner being the heating mode, the first four-way valve 151 and the second four-way valve 152 both are controlled to be powered on.

Figure 3:
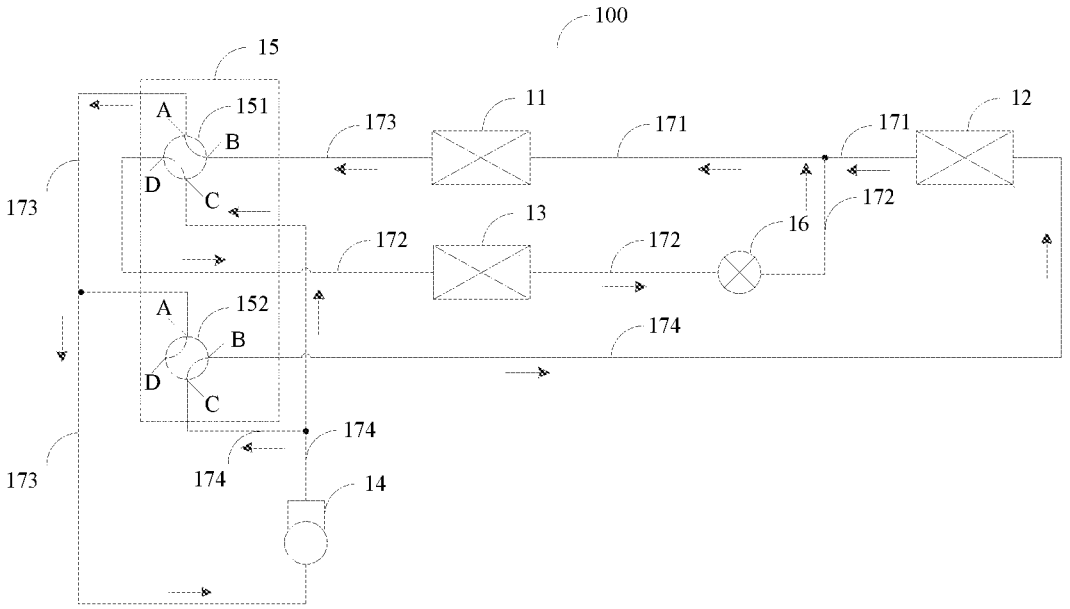
FIG. 3 is a schematic diagram showing a refrigerant flow direction in an air conditioner according to an embodiment of the present disclosure.

As shown in FIG. 3, the first four-way valve 151 is controlled to be powered on, enabling the pipeline between the interface A and the interface B of the first four-way valve 151 to be connected and the pipeline between the interface C and the interface D of the first four-way valve 151 to be connected, while the pipeline between the interface A and the interface D of the first four-way valve 151 to be disconnected and the pipeline between the interface B and the interface C of the first four-way valve 151 to be disconnected.

The second four-way valve 152 is controlled to be powered on, enabling the pipeline between the interface A and the interface D of the second four-way valve 152 to be connected and the pipeline between the interface B and the interface C of the second four-way valve 152 to be connected, while the pipeline between the interface A and the interface B of the second four-way valve 152 to be disconnected and the pipeline between the interface C and the interface D of the second four-way valve 152 to be disconnected.

FIG. 3 shows a refrigerant flow direction in the air conditioner with the above-described connections, where a portion of a high-temperature and high-pressure refrigerant discharged from the compressor 14 enters the indoor heat exchanger 12 for heat release and condensation through the third pipeline 174, and the pipeline between the interface B and the interface C of the second four-way valve 152; another portion of the high-temperature and high-pressure refrigerant discharged from the compressor 14 enters the heat storage heat exchanger 13 for heat release and condensation through the pipeline between the interface C and the interface D of the first four-way valve 151 and the bypass 172, followed by throttling and depressurizing through the throttling assembly 16; and the combined refrigerant enters the outdoor heat exchanger 11 for heat absorption and evaporation, and returns back to the compressor 14 through the pipeline between the interface A and the interface B of the first four-way valve 151 and the second pipeline 173.

It would be appreciated that, in an embodiment of the present disclosure, when the operation mode of the air conditioner is the heating mode, the outdoor heat exchanger 11 serves as an evaporator, while the indoor heat exchanger 12 and the heat storage heat exchanger 13 each serve as a condenser. In other words, when the operation mode of the air conditioner is the heating mode, the heat storage heat exchanger 13 is used to store heat.

At S103, in response to the operation mode of the air conditioner being a defrosting mode, the first four-way valve is controlled to be powered off, and the second four-way valve is controlled to be powered on.

In an embodiment of the present disclosure, in response to the operation mode of the air conditioner being the defrosting mode, the first four-way valve 151 is controlled to be powered off, and the second four-way valve 152 is controlled to be powered on.

Figure 4:
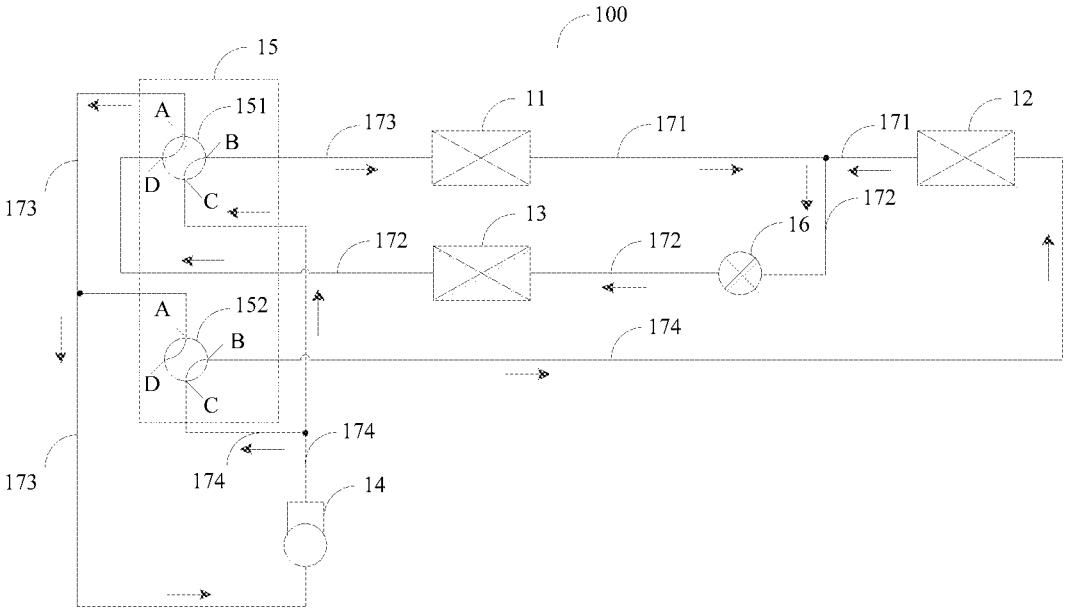
FIG. 4 is a schematic diagram showing a refrigerant flow direction in an air conditioner according to another embodiment of the present disclosure.

As shown in FIG. 4, the first four-way valve 151 is controlled to be powered off, enabling the pipeline between the interface A and the interface D of the first four-way valve 151 to be connected and the pipeline between the interface B and the interface C of the first four-way valve 151 to be connected, while the pipeline between the interface A and the interface B of the first four-way valve 151 to be disconnected and the pipeline between the interface C and the interface D of the first four-way valve 151 to be disconnected.

With respect to the relevant description on controlling the second four-way valve 152 to be powered on, please refer to the above embodiments, which will not be repeated here.

FIG. 4 shows a refrigerant flow direction in the air conditioner with the above-described connections, where a portion of a high-temperature and high-pressure refrigerant discharged from the compressor 14 enters the indoor heat exchanger 12 for heat release and condensation through the third pipeline 174, and the pipeline between the interface B and the interface C of the second four-way valve 152; another portion of the high-temperature and high-pressure refrigerant discharged from the compressor 14 enters the outdoor heat exchanger 11 for heat release and condensation through the pipeline between the interface B and the interface C of the first four-way valve 151, and the second pipeline 173; the combined refrigerant is throttled and depressurized through the throttling assembly 16, before enters the heat storage heat exchanger 13 for heat absorption and evaporation, and returns back to the compressor 14 through the bypass 172, the pipeline between the interface A and the interface D of the first four-way valve 151 and the second pipeline 173.

It would be appreciated that, in an embodiment of the present disclosure, when the operation mode of the air conditioner is the defrosting mode, the outdoor heat exchanger 11 and the indoor exchanger 12 each serve as a condenser, and the heat storage heat exchanger 13 serves as an evaporator. In other words, when the operation mode of the air conditioner is changed from the heating mode to the defrosting mode, the outdoor heat exchanger 11 is converted from serving as the evaporator to serving as the condenser, the indoor heat exchanger 12 continues serving as the condenser, and the heat storage heat exchanger 13 is converted from serving as the condenser to serving the evaporator, and the heat is absorbed from the heat storage heat exchanger 13 for defrosting the outdoor heat exchanger 11 without adversely affecting the heating performance of the indoor heat exchanger 12, to improve the air conditioner for comfort and user's experience.

Summing up the above, according to embodiments of the present disclosure, the method for controlling the air conditioner identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as the condenser, while the heat storage heat exchanger serves as the evaporator, and heat is absorbed from the heat storage heat exchanger for defrosting the outdoor heat exchanger without adversely affecting the heating performance of the indoor heat exchanger, to improve the air conditioner for comfort and user's experience.

On the basis of any of the above embodiments, after controlling the first four-way valve to be powered off and the second four-way valve to be powered on at S103, the method further includes: controlling the first four-way valve and the second four-way valve both to be powered on, in response to identifying that the outdoor heat exchanger is of a first pipe-wall temperature higher than or equal to a first preset temperature and/or that a defrosting duration reaches a first preset duration.

It would be appreciated that identifying that the outdoor heat exchanger is of the first pipe-wall temperature higher than or equal to the first preset temperature and/or that the defrosting duration reaches the first preset duration indicates that the first pipe-wall temperature of the outdoor heat exchanger is relative high and/or that the defrosting duration is relative long at this time. Accordingly, it is determined that a criteria to finish defrosting is met in this circumstance, thus the first four-way valve and the second four-way valve both are controlled to be powered on, enabling the operation mode of the air conditioner to change from the defrosting mode to the heating mode.

The first preset temperature and the first preset duration each may be set according to an actual situation. For example, the first preset temperature may be set as 15° C. and the first preset duration may be set as 10 minutes.

Figure 5:
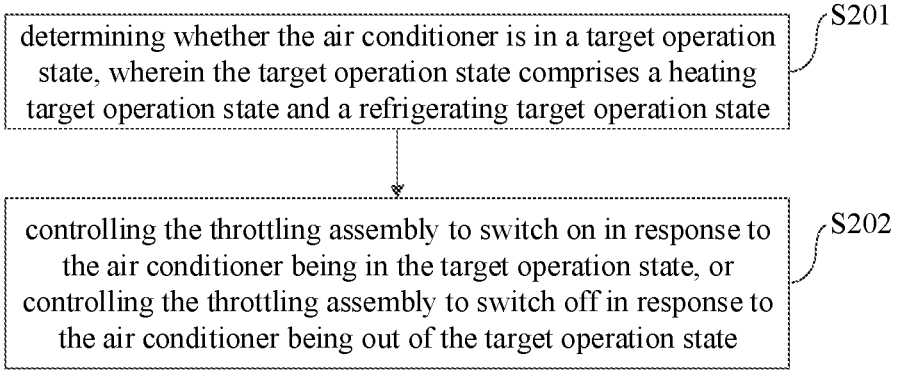
FIG. 5 is a flow chart showing a method for controlling an air conditioner after identifying an operation mode of the air conditioner according to an embodiment of the present disclosure.

On the basis of any of the above embodiments, as shown in FIG. 5, after identifying an operation mode of the air conditioner at S101, the method further includes S201 and S202.

At S201, it is determined whether the air conditioner is in a target operation state, where the target operation state includes a heating target operation state and a cooling target operation state.

In an embodiment of the present disclosure, it is further determined whether the air conditioner is in the target operation state, where the target operation state includes the heating target operation state and the cooling target operation state. It should note that the target operation state refers to an operation state under a low load.

In one embodiment, determining whether the air conditioner is in the target operation state may include the following two possible implementing approaches.

Approach 1, in response to identifying that the air conditioner is of a heating capacity demand parameter (Nh) or a cooling capacity demand parameter (Nc) lower than or equal to a first preset threshold for a second preset duration, it is determined that the air conditioner is in the target operation state; or in response to identifying that the air conditioner is of a heating capacity demand parameter or a cooling capacity demand parameter greater than or equal to a second preset threshold for a third preset duration, it is determined that the air conditioner is not in the target operation state.

It would be appreciated that the heating capacity demand parameter or the cooling capacity demand parameter of the air conditioner may be used to characterize a load of the air conditioner. The smaller the heating capacity demand parameter or the cooling capacity demand parameter of the air conditioner, the lower the load of the air conditioner.

Identifying that the air conditioner is of the heating capacity demand parameter or the cooling capacity demand parameter lower than or equal to the first preset threshold for the second preset duration indicates that the heating capacity demand parameter or the cooling capacity demand parameter of the air conditioner is relative low for a relative long time period at this time. Accordingly, it is determined that the air conditioner is in the target operation state.

In one embodiment, identifying that the air conditioner is of the heating capacity demand parameter or the cooling capacity demand parameter greater than or equal to the second preset threshold for the third preset duration indicates that the heating capacity demand parameter or the cooling capacity demand parameter of the air conditioner is relative high for a relative long time period at this time. Accordingly, it is determined that the air conditioner is out of the target operation state.

The first preset threshold, the second preset threshold, the second preset duration, and the third preset duration each may be set according to an actual situation, which is not further limited here.

Approach 2, in the case that the air conditioner includes the indoor heat exchangers, based on that the operation mode of the air conditioner is a mixed mode, where the mixed mode includes the heating mode for at least one of the indoor heat exchangers and a cooling mode for at least one of the indoor heat exchangers, a heating capacity demand parameter and a cooling capacity demand parameter are acquired; and in response to identifying that the heating capacity demand parameter is lower than or equal to the cooling capacity demand parameter, it is determined that the air conditioner is in the heating target operation state; in one embodiment, in response to identifying that the heating capacity demand parameter is greater than the cooling capacity demand parameter, it is determined that the air conditioner is in the cooling target operation state.

Figure 6:
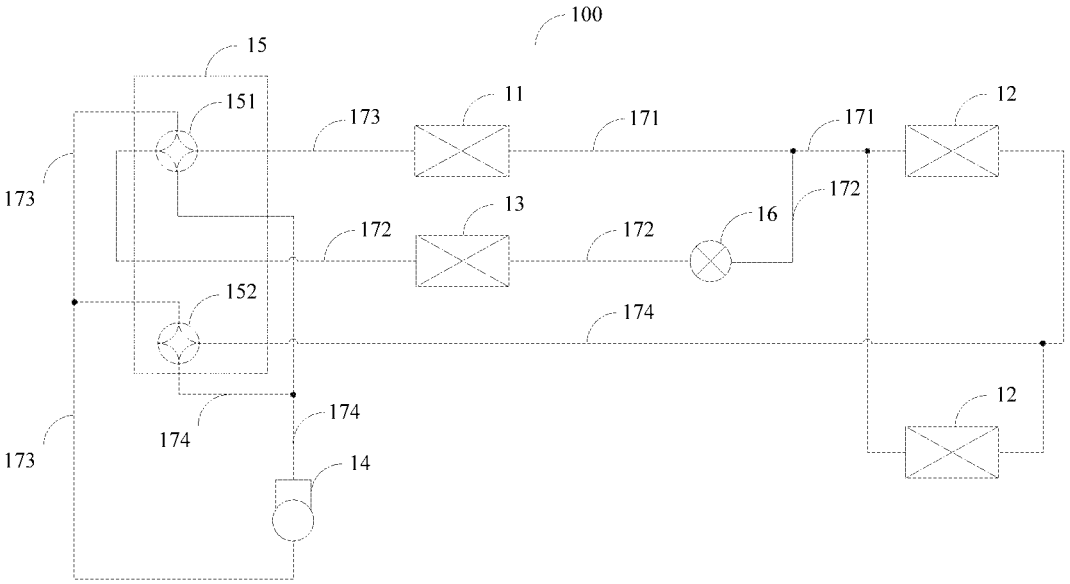
FIG. 6 is a schematic diagram showing a structure of an air conditioner according to another embodiment of the present disclosure.

Taking FIG. 6 as an example, the number of the indoor heat exchangers is 2. In one embodiment, the indoor heat exchangers each may be connected with a switching assembly (not shown in the Figure). It should note that, FIG. 6 is merely an example of the air conditioner in an embodiment of the present disclosure, rather than limitation to the air conditioner in an embodiment of the present disclosure.

In an embodiment of the present disclosure, in the case that the air conditioner includes the indoor heat exchangers, in response to the operation mode of the air conditioner being the mixed mode, where the mixed mode includes the heating mode for at least one of the indoor heat exchangers and the cooling mode for at least one of the indoor heat exchangers, in this circumstance, acquiring the heating capacity demand parameter may include acquiring the heating capacity demand parameter of the indoor heat exchanger in the operation mode being the heating mode; and accordingly, acquiring the cooling capacity demand parameter may include acquiring the cooling capacity demand parameter of the indoor heat exchanger in the operation mode being the cooling mode.

Further, it is identified a relationship between the heating capacity demand parameter and the cooling capacity demand parameter, where identifying that the heating capacity demand parameter is lower than or equal to the cooling capacity demand parameter indicates that the heating capacity demand parameter is relative low, and it is then determined that the air conditioner is in the heating target operation state; in one embodiment, identifying that the heating capacity demand parameter is greater than the cooling capacity demand parameter indicates that the cooling capacity demand parameter is relative low, and it is then determined that the air conditioner is in the cooling target operation state.

At S202, in response to the air conditioner being in the target operation state, the throttling assembly is controlled to switch on; or in response to the air conditioner being out of the target operation state, the throttling assembly is controlled to switch off.

In an embodiment of the present disclosure, in response to the air conditioner being in the target operation state, the throttling assembly is controlled to switch on, enabling the bypass to be connected, allowing the refrigerant to enter the heat storage heat exchanger, and the heat storage heat exchanger is used to store heat in this circumstance, to adjust the load of the air conditioner by the heat storage heat exchanger, assisting in avoiding the air conditioner from being in the operation state under the low load for a long time period, thus improving operation reliability of the air conditioner.

In one embodiment, in response to the air conditioner being out of the target operation state, the throttling assembly is controlled to switch off, enabling the bypass to be disconnected, and the refrigerant cannot enter the heat storage heat exchanger and thus the heat storage heat exchanger is not used to store heat in this circumstance. Accordingly, the load of the air conditioner cannot be adjusted by the heat storage heat exchanger in this circumstance Therefore, the method controls the throttling assembly to switch on or off according to whether the air conditioner is in the target operation state. When the air conditioner is in the target operation state, the throttling assembly is controlled to switch on, to adjust the load of the air conditioner by the heat storage heat exchanger, assisting in avoiding the air conditioner from being in the operation state under the low load for a long time period, thus improving operation reliability of the air conditioner.

The method for controlling the air conditioner in another embodiment of the present disclosure is described below in combination with FIG. 7.

Figure 7:
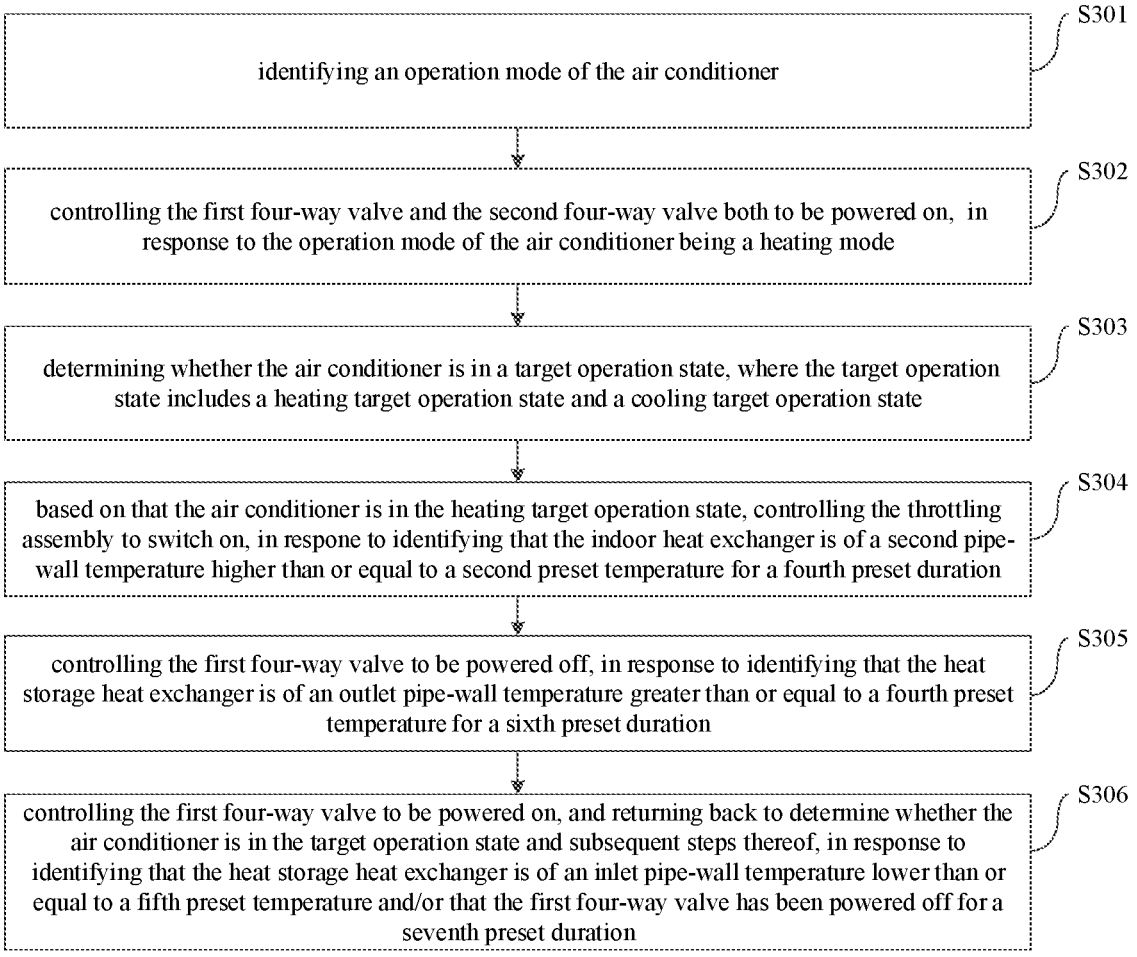
FIG. 7 is a flow chart showing a method for controlling an air conditioner according to another embodiment of the present disclosure.

As shown in FIG. 7, the method for controlling the air conditioner in another embodiment of the present disclosure includes the following steps.

At S301, an operation mode of the air conditioner is identified.

At S302, in response to the operation mode of the air conditioner being a heating mode, the first four-way valve and the second four-way valve both are controlled to be powered on.

At S303, it is determined whether the air conditioner is in a target operation state, where the target operation state includes a heating target operation state and a cooling target operation state.

With respect to the relevant description on steps S301 to S303, please refer to the above embodiments, which will not be repeated here.

At S304, based on that the air conditioner is in the heating target operation state, the throttling assembly is controlled to switch on, in response to identifying that the indoor heat exchanger is of a second pipe-wall temperature higher than or equal to a second preset temperature for a fourth preset duration.

In an embodiment of the present disclosure, based on that the air conditioner is in the heating target operation state, in response to identifying that the indoor heat exchanger is of the second pipe-wall temperature higher than or equal to the second preset temperature for the fourth preset duration, indicating that the second pipe-wall temperature of the indoor heat exchanger is relative high for a relative long time period, the throttling assembly is controlled to switch on, enabling the bypass to be connected, allowing the refrigerant to enter the heat storage heat exchanger for heat release and condensation, where the heat storage heat exchanger serves as a condenser for storing heat in this circumstance.

The second preset temperature and the fourth preset duration each may be set according to an actual situation. For example, the second preset temperature may be set as 58° C. and the fourth preset duration may be set as 8 minutes.

At S305, in response to identifying that the heat storage heat exchanger is of an outlet pipe-wall temperature greater than or equal to a fourth preset temperature for a sixth preset duration, the first four-way valve is controlled to be powered off.

In an embodiment of the present disclosure, after the throttling assembly is controlled to switch on, in response to identifying that the heat storage heat exchanger is of the outlet pipe-wall temperature greater than or equal to the fourth preset temperature for the sixth preset duration, indicating that the outlet pipe-wall temperature of the heat storage heat exchanger is relative high for a relative long time period, the first four-way valve is controlled to be powered off. The refrigerant flow direction in the air conditioner in this circumstance is illustrated in FIG. 4, where the heat storage heat exchanger is converted from serving as the condenser to serving as the evaporator, allowing the refrigerant to enter the heat storage heat exchanger for heat absorption and evaporation, to reduce the outlet pipe-wall temperature of the heat storage heat exchanger.

The fourth preset temperature and the sixth preset duration each may be set according to an actual situation. For example, the fourth preset temperature may be set as 50° C. and the sixth preset duration may be set as 3 minutes.

At S306, in response to identifying that the heat storage heat exchanger is of an inlet pipe-wall temperature lower than or equal to a fifth preset temperature and/or that the first four-way valve has been powered off for a seventh preset duration, the first four-way valve is controlled to be powered on, followed by returning back to determine whether the air conditioner is in the target operation state and subsequent steps thereof.

In an embodiment of the present disclosure, in response to identifying that the heat storage heat exchanger is of the inlet pipe-wall temperature lower than or equal to the fifth preset temperature and/or that the first four-way valve has been powered off for the seventh preset duration, indicating that the inlet pipe-wall temperature of the heat storage heat exchanger is relative low and/or that the first four-way valve has been powered off for a relative long time period, the first four-way valve is controlled to be powered on. The refrigerant flow direction in the air conditioner in this circumstance is illustrated in FIG. 3, where the heat storage heat exchanger is converted from serving as the evaporator to serving as the condenser, allowing the refrigerant to enter the heat storage heat exchanger for heat release and condensation, to increase the inlet pipe-wall temperature of the heat storage heat exchanger, followed by returning back to determine whether the air conditioner is in the target operation state and subsequent steps thereof.

The fifth preset temperature and the seventh preset duration each may be set according to an actual situation. For example, the fifth preset temperature may be set as 50° C. and the seventh preset duration may be set as 10 minutes.

Therefore, in response to the air conditioner being in the heating target operation state, the method controls the first four-way valve to be powered off according to the outlet pipe-wall temperature of the heat storage heat exchanger, and controls the first four-way valve to be powered on according to the inlet pipe-wall temperature of the heat storage heat exchanger, to adjust the load of the air conditioner by the heat storage heat exchanger, assisting in avoiding the air conditioner from being in the operation state under the low load for a long time period, thus improving operation reliability of the air conditioner.

The method for controlling the air conditioner in another embodiment of the present disclosure is described below in combination with FIG. 8.

Figure 8:
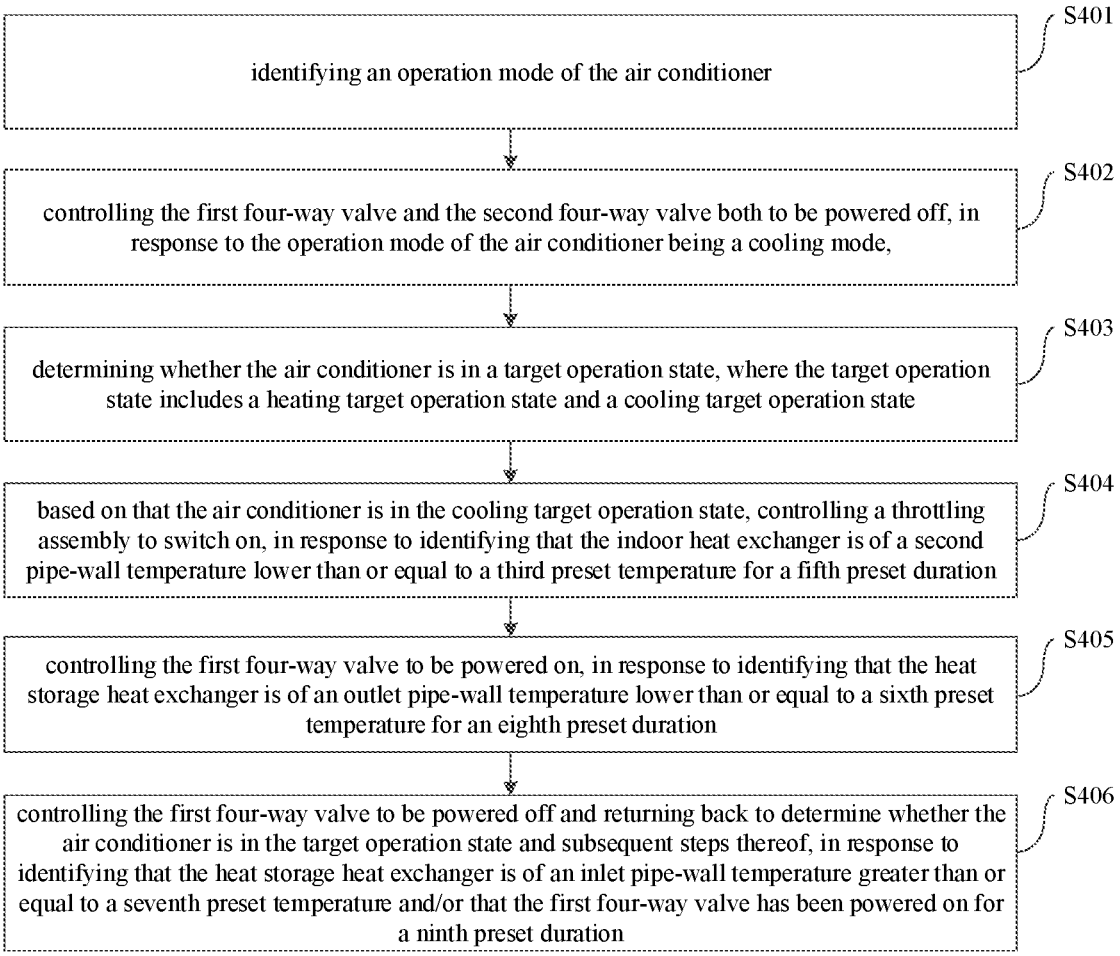
FIG. 8 is a flow chart showing a method for controlling an air conditioner according to another embodiment of the present disclosure.

As shown in FIG. 8, the method for controlling the air conditioner in another embodiment of the present disclosure includes the following steps.

At S401, an operation mode of the air conditioner is identified.

With respect to the relevant description on S401, please refer to the above embodiments, which will not be repeated here.

At S402, in response to the operation mode of the air conditioner being a cooling mode, the first four-way valve and the second four-way valve both are controlled to be powered off.

In an embodiment of the present disclosure, in response to the operation mode of the air conditioner being the cooling mode, the first four-way valve 151 and the second four-way valve 152 both are controlled to be powered off.

With respect to the relevant description on controlling the first four-way valve 151 to be powered off, please refer to the above embodiment, which will not be repeated here.

The second four-way valve 152 is controlled to be powered off, enabling the pipeline between the interface A and the interface B of the second four-way valve 152 to be connected and the pipeline between the interface C and the interface D of the second four-way valve 152 to be connected, while the pipeline between the interface A and the interface D of the second four-way valve 152 to be disconnected and the pipeline between the interface B and the interface C of the second four-way valve 152 to be disconnected.

At S403, it is determined whether the air conditioner is in a target operation state, where the target operation state includes a heating target operation state and a cooling target operation state.

With respect to the relevant description on S403, please refer to the above embodiments, which will not be repeated here.

At S404, based on that the air conditioner is in the cooling target operation state, in response to identifying that the indoor heat exchanger is of a second pipe-wall temperature lower than or equal to a third preset temperature for a fifth preset duration, a throttling assembly is controlled to switch on.

In an embodiment of the present disclosure, based on that the air conditioner is in the cooling target operation mode, in response to identifying that the indoor heat exchanger is of the second pipe-wall temperature lower than or equal to the third preset temperature for the fifth preset duration, indicating that the second pipe-wall temperature of the indoor heat exchanger is relative low for a relative long time period, the throttling assembly is controlled to switch on, enabling the bypass to be connected, allowing the refrigerant to enter the heat storage heat exchanger for heat absorption and evaporation, where the heat storage heat exchanger serves as the evaporator for storing heat in this circumstance.

The third preset temperature and the fifth preset duration each may be set according to an actual situation. For example, the third preset temperature may be set as 2° C. and the fifth preset duration may be set as 8 minutes.

Figure 9:
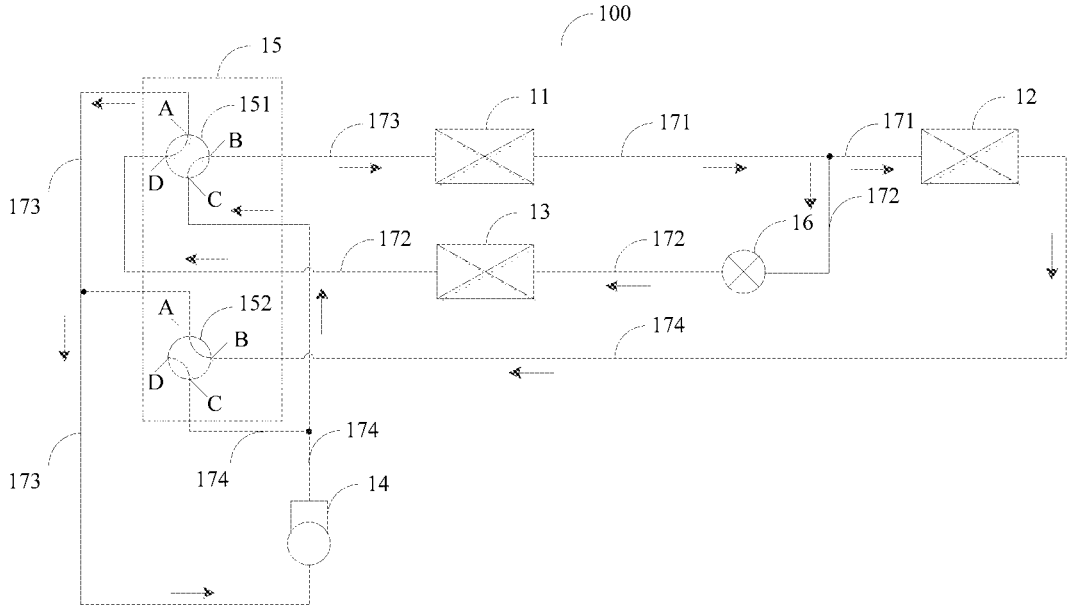
FIG. 9 is a schematic diagram showing a refrigerant flow direction in an air conditioner according to another embodiment of the present disclosure.

FIG. 9 shows a refrigerant flow direction in the air conditioner with the above-described connections, where a high-temperature and high-pressure refrigerant discharged from the compressor 14 enters the outdoor heat exchanger 11 for heat release and condensation through the pipeline between the interface B and the interface C of the first four-way valve 151, and the second pipeline 173; a portion of the refrigerant discharged from the outdoor heat exchanger 11 is throttled and depressurized through the throttling assembly 16, before enters the heat storage heat exchanger 13 for heat absorption and evaporation, and returns back to the compressor 14 through the bypass 172, the pipeline between the interface A and the interface D of the first four-way valve 151, and the second pipeline 173; and another portion of the refrigerant discharged from the outdoor heat exchanger 11 enters the indoor heat exchanger 12 for heat absorption and evaporation, and returns back to the compressor 14 through the third pipeline 174, the pipeline between the interface A and the interface B of the second four-way valve 152, and the second pipeline 173. It would be appreciated that the outdoor heat exchanger 11 servers as a condenser, while the indoor heat exchanger 12 and the heat storage heat exchanger 13 each serve as an evaporator in this circumstance.

At S405, in response to identifying that the heat storage heat exchanger is of an outlet pipe-wall temperature lower than or equal to a sixth preset temperature for an eighth preset duration, the first four-way valve is controlled to be powered on.

In an embodiment of the present disclosure, after the throttling assembly is controlled to switch on, in response to identifying that the heat storage heat exchanger is of the outlet pipe-wall temperature lower than or equal to the sixth preset temperature for the eighth preset duration, indicating that the outlet pipe-wall temperature of the heat storage heat exchanger is relative low for a relative long time period, the first four-way valve is controlled to be powered on, and the heat storage heat exchanger is converted from serving as the evaporator to serving as the condenser, allowing the refrigerant to enter the heat storage heat exchanger for heat release and condensation, to increase the outlet pipe-wall temperature of the heat storage heat exchanger.

The sixth preset temperature and the eighth preset duration each may be set according to an actual situation. For example, the sixth preset temperature may be set as 2° C. and the eighth preset duration may be set as 8 minutes.

Figure 10:
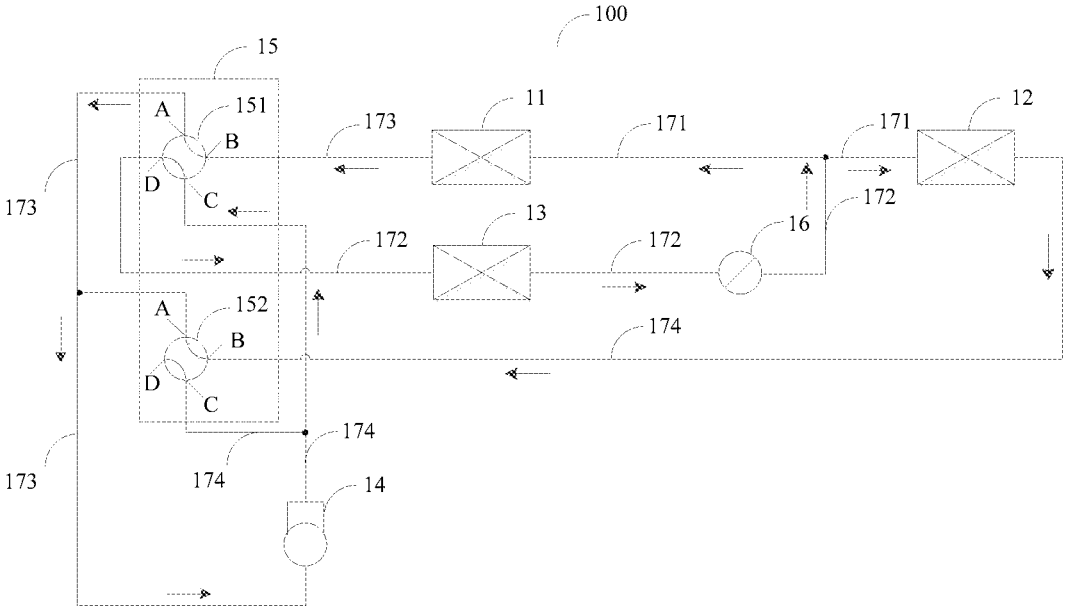
FIG. 10 is a schematic diagram showing a refrigerant flow direction in an air conditioner according to another embodiment of the present disclosure.

FIG. 10 shows a refrigerant flow direction in the air conditioner with the above-described connections, where a high-temperature and high-pressure refrigerant discharged from the compressor 14 enters the heat storage heat exchanger 13 for heat release and condensation through the pipeline between the interface C and the interface D of the first four-way valve 151, and the bypass 172, followed by throttling and depressurizing through the throttling assembly 16; a portion of the refrigerant discharged from the throttling assembly 16 enters the outdoor heat exchanger 11 for heat absorption and evaporation, and returns back to the compressor 14 through the second pipeline 173, and the pipeline between the interface A and the interface B of the first four-way valve 151; and another portion of the refrigerant discharged from the throttling assembly 16 enters the indoor heat exchanger 12 for heat absorption and evaporation, and returns back to the compressor 14 through the third pipeline 174, the pipeline between the interface A and the interface B of the second four-way valve 152, and the second pipeline 173. It would be appreciated that the outdoor heat exchanger 11 and the indoor heat exchanger 12 each server as the evaporator, while the heat storage heat exchanger 13 serves as the condenser in this circumstance.

At S406, in response to identifying that the heat storage heat exchanger is of an inlet pipe-wall temperature greater than or equal to a seventh preset temperature and/or that the first four-way valve has been powered on for a ninth preset duration, the first four-way valve is controlled to be powered off, followed by returning back to determine whether the air conditioner is in the target operation state and subsequent steps thereof.

In an embodiment of the present disclosure, in response to identifying that the heat storage heat exchanger is of the inlet pipe-wall temperature greater than or equal to the seventh preset temperature and/or that the first four-way valve has been powered on for the ninth preset duration, indicating that the inlet pipe-wall temperature of the heat storage heat exchanger is relative high and/or that the first four-way valve has been powered on for a relative long time period, the first four-way valve is controlled to be powered off. The refrigerant flow direction in the air conditioner in this circumstance is illustrated in FIG. 9, where the heat storage heat exchanger is converted from serving as the condenser to serving as the evaporator, allowing the refrigerant to enter the heat storage heat exchanger for heat absorption and evaporation, to reduce the inlet pipe-wall temperature of the heat storage heat exchanger, followed by returning back to determine whether the air conditioner is in the target operation state and subsequent steps thereof.

The seventh preset temperature and the ninth preset duration each may be set according to an actual situation. For example, the seventh preset temperature may be set as 60° C. and the ninth preset duration may be set as 10 minutes.

Therefore, in response to the air conditioner being in the cooling target operation state, the method controls the first four-way valve to be powered on according to the outlet pipe-wall temperature of the heat storage heat exchanger, and controls the first four-way valve to be powered off according to the inlet pipe-wall temperature of the heat storage heat exchanger, to adjust the load of the air conditioner by the heat storage heat exchanger, assisting in avoiding the air conditioner from being in the operation state under the low load for a long time period, thus improving operation reliability of the air conditioner.

The method for controlling the air conditioner in another embodiment of the present disclosure is described below in combination with FIG. 11.

Figure 12:
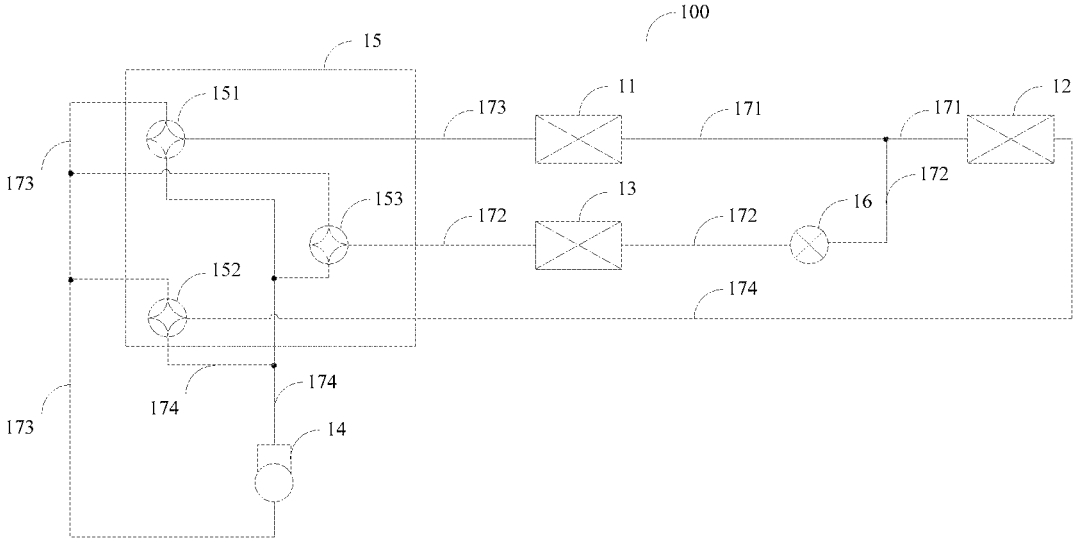
FIG. 12 is a schematic diagram showing a structure of an air conditioner according to another embodiment of the present disclosure.

It should note that, as shown in FIG. 12, in an embodiment of the present disclosure, the four-way valve assembly 15 further includes a third four-way valve 153 arranged at the bypass 172.

Figure 11:
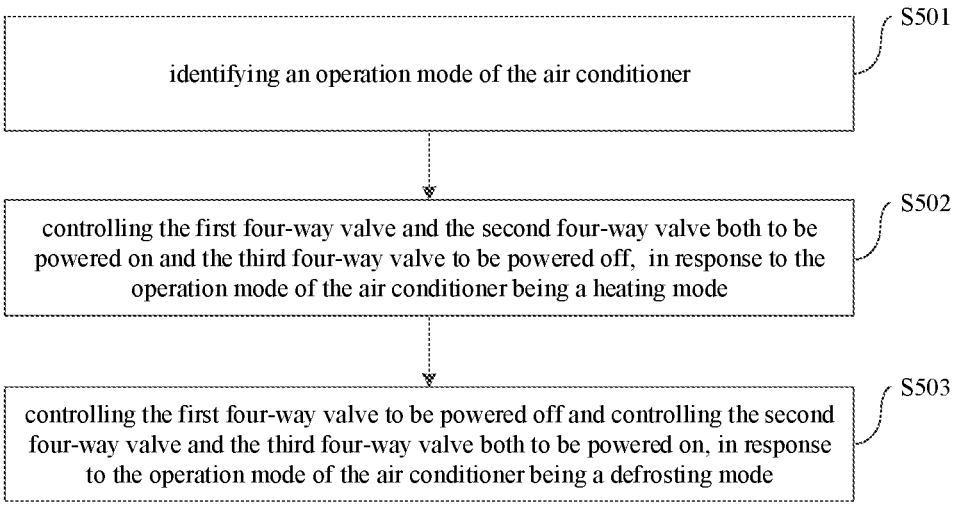
FIG. 11 is a flow chart showing a method for controlling an air conditioner according to another embodiment of the present disclosure.

As shown in FIG. 11, the method for controlling the air conditioner in another embodiment of the present disclosure includes the following steps.

At S501, an operation mode of the air conditioner is identified.

With respect to the relevant description on S501, please refer to the above embodiments, which will not be repeated here.

At S502, in response to the operation mode of the air conditioner being a heating mode, the first four-way valve and the second four-way valve both are controlled to be powered on, and the third four-way valve is controlled to be powered off.

In an embodiment of the present disclosure, in response to the operation mode of the air conditioner being the heating mode, the first four-way valve 151 and the second four-way valve 152 both are controlled to be powered on, and the third four-way valve 153 is controlled to be powered off.

With respect to the relevant description on controlling the first four-way valve 151 and the second four-way valve 152 both to be powered on, please refer to the above embodiments, which will not be repeated here.

Figure 13:
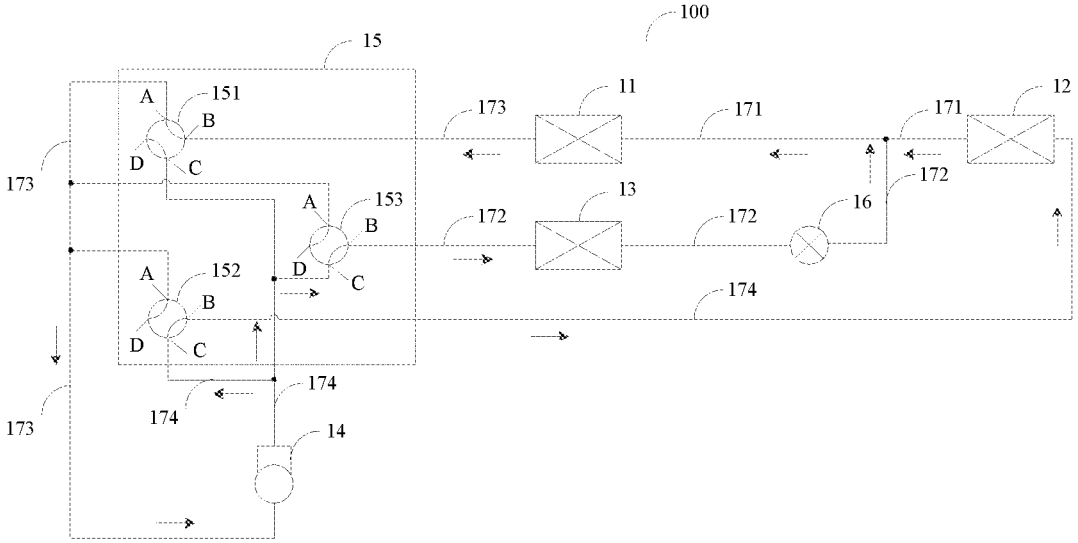
FIG. 13 is a schematic diagram showing a refrigerant flow direction in an air conditioner according to another embodiment of the present disclosure.

As shown in FIG. 13, the third four-way valve 153 is controlled to be powered off, enabling the pipeline between the interface A and the interface D of the third four-way valve 153 to be connected and the pipeline between the interface B and the interface C of the third four-way valve 153 to be connected, while the pipeline between the interface A and the interface B of the third four-way valve 153 to be disconnected and the pipeline between the interface C and the interface D of the third four-way valve 153 to be disconnected.

FIG. 13 shows a refrigerant flow direction in the air conditioner with the above-described connections, where a portion of a high-temperature and high-pressure refrigerant discharged from the compressor 14 enters the indoor heat exchanger 12 for heat release and condensation through the third pipeline 174, and the pipeline between the interface B and the interface C of the second four-way valve 152; another portion of the high-temperature and high-pressure refrigerant discharged from the compressor 14 enters the heat storage heat exchanger 13 for heat release and condensation through the pipeline between the interface B and the interface C of the third four-way valve 153, and the bypass 172, followed by throttling and depressurizing through the throttling assembly 16; and the combined refrigerant enters the outdoor heat exchanger 11 for heat absorption and evaporation, and returns back to the compressor 14 through the pipeline between the interface A and the interface B of the first four-way valve 151, and the second pipeline 173.

It would be appreciated that, in an embodiment of the present disclosure, when the operation mode of the air conditioner is the heating mode, the outdoor heat exchanger 11 serves as an evaporator, while the indoor heat exchanger 12 and the heat storage heat exchanger 13 each serve as a condenser. In other words, when the operation mode of the air conditioner is the heating mode, the heat storage heat exchanger 13 is used to store heat.

At S503, in response to the operation mode of the air conditioner being a defrosting mode, the first four-way valve is controlled to be powered off, and the second four-way valve and the third four-way valve both are controlled to be powered on.

In an embodiment of the present disclosure, in response to the operation mode of the air conditioner being the defrosting mode, the first four-way valve 151 is controlled to be powered off; and the second four-way valve 152 and the third four-way valve 153 both are controlled to be powered on.

With respect to the relevant description on controlling the first four-way valve 151 to be powered off and controlling the second four-way valve 152 to be powered on, please refer to the above embodiments, which will not be repeated here.

Figure 14:
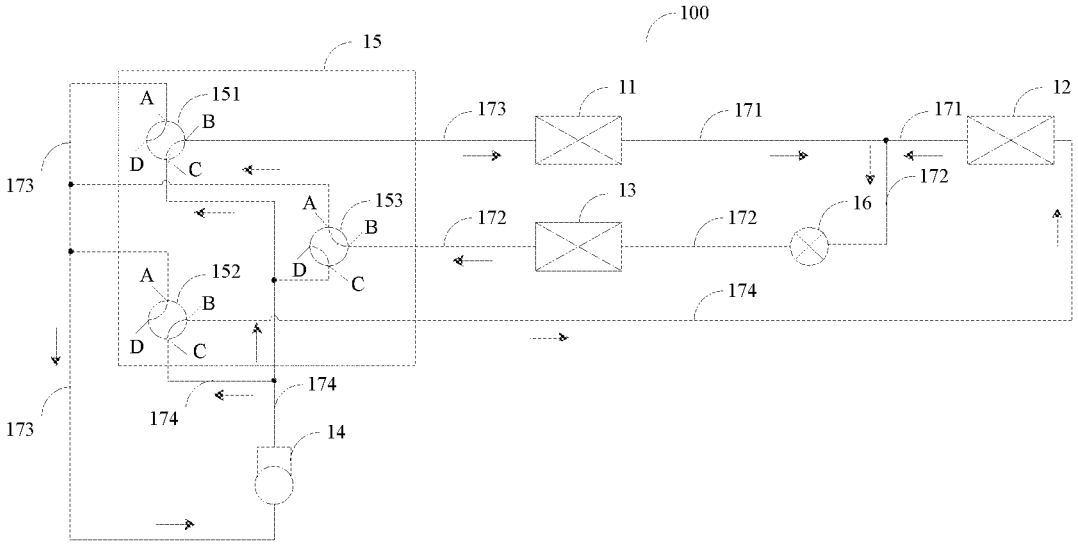
FIG. 14 is a schematic diagram showing a refrigerant flow direction in an air conditioner according to another embodiment of the present disclosure.

As shown in FIG. 14, the third four-way valve 153 is controlled to be powered on, enabling the pipeline between the interface A and the interface B of the third four-way valve 153 to be connected and the pipeline between the interface C and the interface D of the third four-way valve 153 to be connected, while the pipeline between the interface A and the interface D of the third four-way valve 153 to be disconnected and the pipeline between the interface B and the interface C of the third four-way valve 153 to be disconnected.

FIG. 14 shows a refrigerant flow direction in the air conditioner with the above-described connections, where a portion of a high-temperature and high-pressure refrigerant discharged from the compressor 14 enters the indoor heat exchanger 12 for heat release and condensation through the third pipeline 174, and the pipeline between the interface B and the interface C of the second four-way valve 152; another portion of the high-temperature and high-pressure refrigerant discharged from the compressor 14 enters the outdoor heat exchanger 11 for heat release and condensation through the pipeline between the interface B and the interface C of the first four-way valve 151, and the second pipeline 173; and the combined refrigerant is throttled and depressurized through the throttling assembly 16, before enters the heat storage heat exchanger 13 for heat absorption and evaporation, and returns back to the compressor 14 through the bypass 172, the pipeline between the interface A and the interface B of the third four-way valve 153, and the second pipeline 173.

It would be appreciated that, in an embodiment of the present disclosure, when the operation mode of the air conditioner is the defrosting mode, the outdoor heat exchanger 11 and the indoor exchanger 12 each serve as a condenser, and the heat storage heat exchanger 13 serves as an evaporator. In other words, when the operation mode of the air conditioner is changed from the heating mode to the defrosting mode, the outdoor heat exchanger 11 is converted from serving as the evaporator to serving as the condenser, the indoor heat exchanger 12 continues serving as the condenser, and the heat storage heat exchanger 13 is converted from serving as the condenser to serving the evaporator, and the heat is absorbed from the heat storage heat exchanger 13 for defrosting the outdoor heat exchanger 11 without adversely affecting the heating performance of the indoor heat exchanger 12, to improve the air conditioner for comfort and user's experience.

Summing up the above, according to embodiments of the present disclosure, the method for controlling the air conditioner identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as the condenser, while the heat storage heat exchanger serves as the evaporator, and heat is absorbed from the heat storage heat exchanger for defrosting the outdoor heat exchanger without adversely affecting the heating performance of the indoor heat exchanger, to improve the air conditioner for comfort and user's experience.

On the basis of any of the above embodiments, after controlling the first four-way valve to be powered off, the second four-way valve to be powered on, and the third four-way valve to be powered on at S503, the method further includes: controlling the first four-way valve and the second four-way valve both to be powered on, and the third four-way valve to be powered off, in response to identifying that the outdoor heat exchanger is of a first pipe-wall temperature higher than or equal to a first preset temperature and/or that a defrosting duration reaches a first preset duration.

It would be appreciated that identifying that the outdoor heat exchanger is of the first pipe-wall temperature higher than or equal to the first preset temperature and/or that the defrosting duration reaches the first preset duration indicates that the first pipe-wall temperature of the outdoor heat exchanger is relative high and/or that the defrosting duration is relative long at this time. Accordingly, it is determined that a criteria to finish defrosting is met in this circumstance, thus the first four-way valve and the second four-way valve both are controlled to be powered on, and the third four-way valve is controlled to be powered off, enabling the operation mode of the air conditioner to change from the defrosting mode to the heating mode.

The first preset temperature and the first preset duration each may be set according to an actual situation. For example, the first preset temperature may be set as 15° C. and the first preset duration may be set as 10 minutes.

On the basis of any of the above embodiments, the method further includes: controlling the first four-way valve and the second four-way valve both to be powered off and the third four-way valve to be powered on in response to the operation mode of the air conditioner being a cooling mode.

With respect to the relevant description on controlling the first four-way valve 151 and the second four-way valve 152 both to be powered off and the third four-way valve 153 to be powered on, please refer to the above embodiments, which will not be repeated here.

Figure 15:
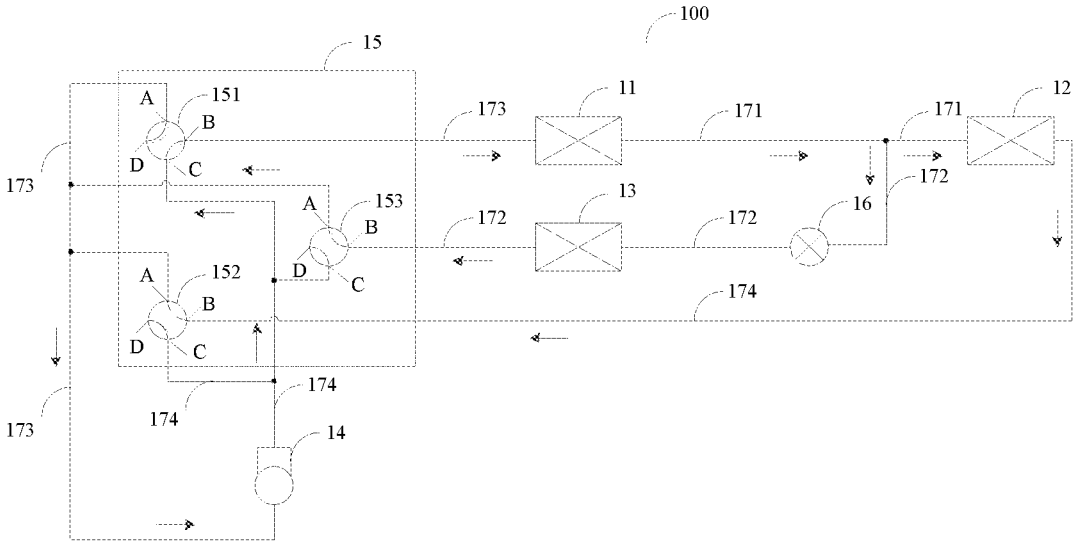
FIG. 15 is a schematic diagram showing a refrigerant flow direction in an air conditioner according to another embodiment of the present disclosure.

FIG. 15 shows a refrigerant flow direction in the air conditioner with the above-described connections, where a high-temperature and high-pressure refrigerant discharged from the compressor 14 enters the outdoor heat exchanger 11 for heat release and condensation through the pipeline between the interface B and the interface C of the first four-way valve 151, and the second pipeline 173; a portion of the refrigerant discharged from the outdoor heat exchanger 11 is throttled and depressurized through the throttling assembly 16, before enters the heat storage heat exchanger 13 for heat absorption and evaporation, and returns back to the compressor 14 through the bypass 172, the pipeline between the interface A and the interface B of the third four-way valve 153, and the second pipeline 173; and another portion of the high-temperature and high-pressure refrigerant discharged from the outdoor heat exchanger 11 enters the indoor heat exchanger 12 for heat absorption and evaporation, and returns back to the compressor 14 through the third pipeline 174, the pipeline between the interface A and the interface B of the second four-way valve 152, and the second pipeline 173. It would be appreciated that the outdoor heat exchanger 11 servers as a condenser, while the indoor heat exchanger 12 and the heat storage heat exchanger 13 each serve as an evaporator in this circumstance.

It should note that respective refrigerant flow directions in the air conditioner as illustrated in FIGS. 3, 4, 9, 10 and 13-15 are merely examples of the refrigerant flow direction in the air conditioner in embodiments of the present disclosure, rather than limitation to the refrigerant flow direction in the air conditioner in an embodiment of the present disclosure.

Figure 16:
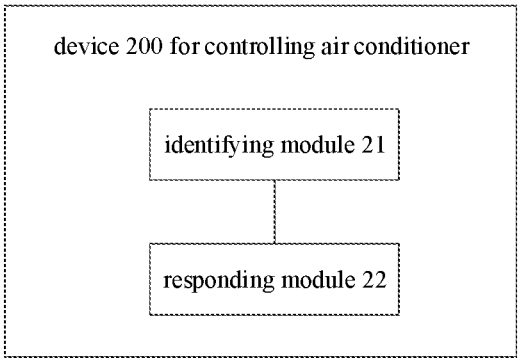
FIG. 16 is a block diagram showing a device for controlling an air conditioner according to an embodiment of the present disclosure.

FIG. 16 is a block diagram showing a device for controlling an air conditioner according to an embodiment of the present disclosure.

The air conditioner includes an outdoor heat exchanger, an indoor heat exchanger, a heat storage heat exchanger, a compressor, a four-way valve assembly, and a throttling assembly. The outdoor heat exchanger is connected to the indoor heat exchanger through either a first pipeline or a bypass. The outdoor heat exchanger is connected to the compressor through a second pipeline. The indoor heat exchanger is connected to the compressor through a third pipeline. The heat storage heat exchanger is arranged at the bypass, and the throttling assembly is arranged at the bypass. The four-way valve assembly includes a first four-way valve and a second four-way valve. The first four-way valve is arranged at the second pipeline, and the second four-way valve is arranged at the third pipeline.

As shown in FIG. 16, in an embodiment of the present disclosure, the device 200 for controlling the air conditioner includes: an identifying device 21 and a responding device 22.

The identifying device 21 is configured to identify an operation mode of the air conditioner.

The responding device 22 is configured to control the first four-way valve and the second four-way valve both to be powered on in response to the operation mode of the air conditioner being a heating mode.

The responding device 22 is also configured to control the first four-way valve to be powered off and the second four-way valve to be powered on in response to the operation mode of the air conditioner being a defrosting mode.

In an embodiment of the present disclosure, the device 200 for controlling the air conditioner further includes a controlling device. After the first four-way valve is controlled to be powered off and the second four-way valve is controlled to be powered on, the controlling device is configured to control the first four-way valve and the second four-way valve both to be powered on, in response to identifying that the outdoor heat exchanger is of a first pipe-wall temperature higher than or equal to a first preset temperature and/or that a defrosting duration reaches a first preset duration.

In an embodiment of the present disclosure, the device 200 for controlling the air conditioner further includes a determining device, configured to determine whether the air conditioner is in a target operation state, and the target operation state includes a heating target operation state and a cooling target operation state; and the responding device is further configured to control the throttling assembly to switch on in response to the air conditioner being in the target operation state, or control the throttling assembly to switch off in response to the air conditioner being out of the target operation state.

In an embodiment of the present disclosure, the determining device is configured to determine that the air conditioner is in the target operation state, in response to identifying that the air conditioner is of a heating capacity demand parameter or a cooling capacity demand parameter lower than or equal to a first preset threshold for a second preset duration; or determine that the air conditioner is out of the target operation state, in response to identifying that the air conditioner is of a heating capacity demand parameter or a cooling capacity demand parameter greater than or equal to a second preset threshold for a third preset duration.

In an embodiment of the present disclosure, the air conditioner includes the indoor heat exchangers, and the determining device is configured to, based on that the operation mode of the air conditioner is a mixed mode, and the mixed mode includes the heating mode for at least one of the indoor heat exchangers and a cooling mode for at least one of the indoor heat exchangers, acquire a heating capacity demand parameter and a cooling capacity demand parameter; determine that the air conditioner is in the heating target operation state, in response to identifying that the heating capacity demand parameter is lower than or equal to the cooling capacity demand parameter, or determine that the air conditioner is in the cooling target operation state, in response to identifying that the heating capacity demand parameter is greater than the cooling capacity demand parameter.

In an embodiment of the present disclosure, before the throttling assembly is controlled to switch on, the responding device is further configured to identify that the indoor heat exchanger is of a second pipe-wall temperature higher than or equal to a second preset temperature for a fourth preset duration in response to the air conditioner being in the heating target operation state; or identify that the indoor heat exchanger is of a second pipe-wall temperature lower than or equal to a third preset temperature for a fifth preset duration in response to the air conditioner being in the cooling target operation state.

In an embodiment of the present disclosure, after the throttling assembly is controlled to switch on, the responding device is further configured to, based on that the air conditioner is in the heating target operation state, control the first four-way valve to be powered off, in response to identifying that the heat storage heat exchanger is of an outlet pipe-wall temperature greater than or equal to a fourth preset temperature for a sixth preset duration; and control the first four-way valve to be powered on, and return back to determine whether the air conditioner is in the target operation state and subsequent steps thereof, in response to identifying that the heat storage heat exchanger is of an inlet pipe-wall temperature lower than or equal to a fifth preset temperature and/or that the first four-way valve has been powered off for a seventh preset duration.

In an embodiment of the present disclosure, after the throttling assembly is controlled to switch on, the responding device is further configured to, based on that the air conditioner is in the cooling target operation state, control the first four-way valve to be powered on, in response to identifying that the heat storage heat exchanger is of an outlet pipe-wall temperature lower than or equal to a sixth preset temperature for an eighth preset duration; and control the first four-way valve to be powered off, and return back to determine whether the air conditioner is in the target operation state and subsequent steps thereof, in response to identifying that the heat storage heat exchanger is of an inlet pipe-wall temperature greater than or equal to a seventh preset temperature and/or that the first four-way valve has been powered on for a ninth preset duration.

In an embodiment of the present disclosure, the four-way valve assembly further includes a third four-way valve arranged at the bypass; and the responding device is further configured to control the third four-way valve to be powered off in response to the operation mode of the air conditioner being the heating mode; and control the third four-way valve to be powered on in response to the operation mode of the air conditioner being the defrosting mode.

In an embodiment of the present disclosure, the responding device is further configured to control the first four-way valve and the second four-way valve both to be powered off and the third four-way valve to be powered on, in response to the operation mode of the air conditioner being the cooling mode.

It should note that details not disclosed for the device for controlling the air conditioner in embodiments of the present disclosure can refer to the disclosed details for the method for controlling the air conditioner in embodiments of the present disclosure, which is not repeated here.

Summing up the above, according to embodiments of the present disclosure, the device for controlling the air conditioner identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as the condenser, while the heat storage heat exchanger serves as the evaporator, and heat is absorbed from the heat storage heat exchanger for defrosting the outdoor heat exchanger without adversely affecting the heating performance of the indoor heat exchanger, to improve the air conditioner for comfort and user's experience.

Figure 17:
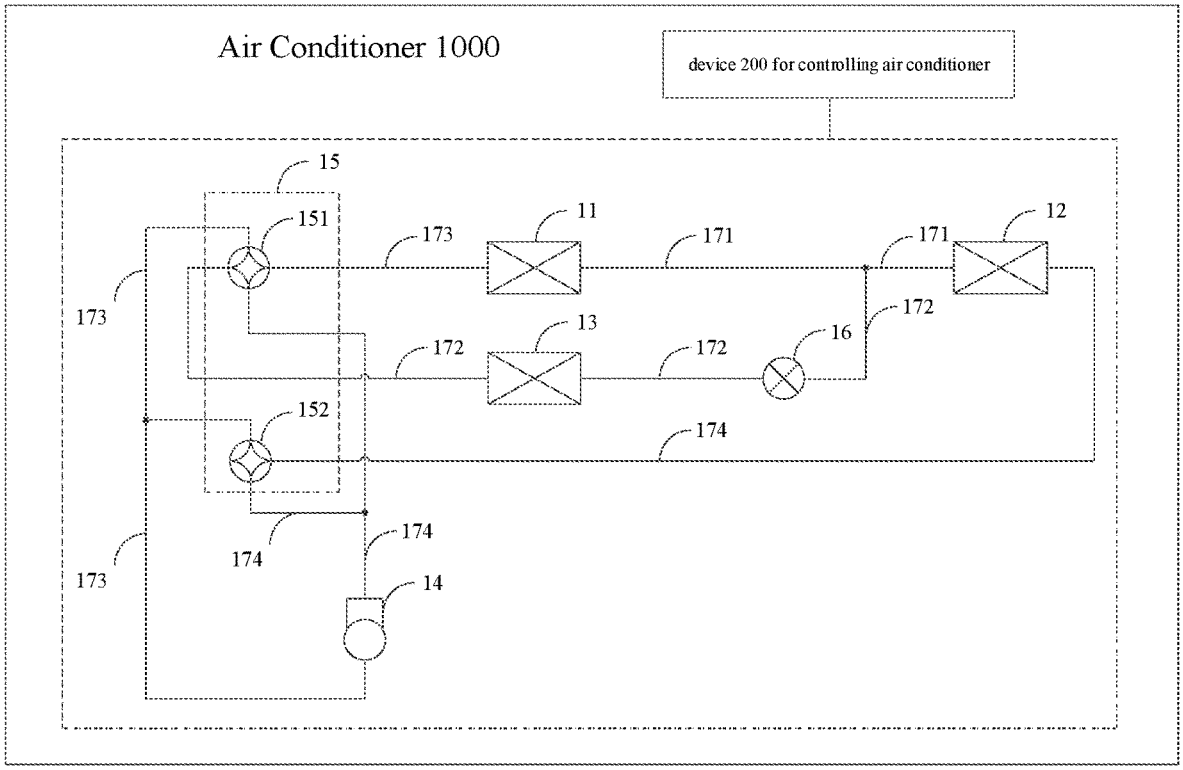
FIG. 17 is a block diagram showing an air conditioner according to an embodiment of the present disclosure.

The embodiments of the present disclosure further provide in an embodiment an air conditioner 1000. As shown in FIG. 17, in an embodiment of the present disclosure, the air conditioner 1000 includes: the outdoor heat exchanger 11, the indoor heat exchanger 12, the heat storage heat exchanger 13, the compressor 14, the four-way valve assembly 15, and the throttling assembly 16. The outdoor heat exchanger 11 is connected to the indoor heat exchanger 12 through either the first pipeline 171 or the bypass 172. The outdoor heat exchanger 11 is connected to the compressor 14 through the second pipeline 173. The indoor heat exchanger 12 is connected to the compressor 14 through the third pipeline 174. The heat storage heat exchanger 13 is arranged at the bypass 172, and the bypass 172 is provided with the throttling assembly 16. The four-way valve assembly 15 includes the first four-way valve 151 and the second four-way valve 152. The first four-way valve 151 is arranged at the second pipeline 173, and the second four-way valve 152 is arranged at the third pipeline 174. The air conditioner 1000 also includes the device 200 for controlling the air conditioner as described above. It should note that the air conditioner as illustrated in FIG. 17 is merely an example of the air conditioner in an embodiment of the present disclosure, rather than limitation to the air conditioner in an embodiment of the present disclosure.

In an embodiment of the present disclosure, the four-way valve assembly further includes a third four-way valve arranged at the bypass.

Summing up the above, according to embodiments of the present disclosure, the air conditioner identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as the condenser, while the heat storage heat exchanger serves as the evaporator, and heat is absorbed from the heat storage heat exchanger for defrosting the outdoor heat exchanger without adversely affecting the heating performance of the indoor heat exchanger, to improve the air conditioner for comfort and user's experience.

Figure 18:
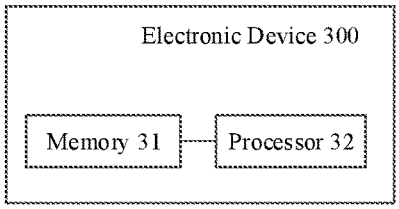
FIG. 18 is a block diagram showing an electronic device according to an embodiment of the present disclosure.

Embodiments of the present disclosure further provide in an embodiment an electronic device 300. As shown in FIG. 18, the electronic device includes a memory 31 and a processor 32. The processor 32 runs a program corresponding to an executable program code by reading the executable program code stored in the memory 32, to implement the method for controlling the air conditioner as described above.

According to embodiments of the present disclosure, the electronic device, by means of the processor executing the computer program stored in the memory, identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as a condenser, while the heat storage heat exchanger serves as an evaporator, and heat is absorbed from the heat storage heat exchanger for defrosting the outdoor heat exchanger without adversely affecting the heating performance of the indoor heat exchanger, to improve the air conditioner for comfort and user's experience.

Embodiments of the present disclosure further provide in an embodiment a computer readable storage medium having stored therein a computer program that, when executed by a processor, implements the method for controlling the air conditioner as described above.

According to embodiments of the present disclosure, the computer readable storage medium, by having stored therein the computer program that is executed by the processor, identifies the operation mode of the air conditioner; controls the first four-way valve and the second four-way valve both to be powered on in response to the operation mode of the air conditioner being the heating mode; and controls the first four-way valve to be powered off and the second four-way valve to be powered on in response to the operation mode of the air conditioner being the defrosting mode. Accordingly, when the operation mode of the air conditioner is the defrosting mode, the outdoor heat exchanger and the indoor heat exchanger each serve as a condenser, while the heat storage heat exchanger serves as an evaporator, and heat is absorbed from the heat storage heat exchanger for defrosting the outdoor heat exchanger without adversely affecting the heating performance of the indoor heat exchanger, to improve the air conditioner for comfort and user's experience.

In the specification, it should be understood that, the terms indicating orientation or position relationship such as "central", "longitudinal", "lateral", "width", "thickness", "above", "below", "front", "rear", "right", "left", "vertical", "horizontal", "top", "bottom", "inner", "outer", "clockwise", "counter-clockwise", "axial", "radial", "circumferential" should be construed to refer to the orientation or position relationship as described or as shown in the drawings. These terms are merely for convenience and concision of description and do not alone indicate or imply that the device or element referred to must have a particular orientation or must be configured or operated in a particular orientation. Thus, it cannot be understood to limit the present disclosure.

In addition, terms such as "first" and "second" are used herein for purposes of description and are not intended to indicate or imply relative importance or significance or impliedly indicate quantity of the embodiment referred to. Thus, the feature defined with "first" and "second" may include one or more this features. In the description of the present disclosure, "a plurality of" means two or more than two this features, unless specified otherwise.

In the present disclosure, unless specified or limited otherwise, the terms "mounted", "connected", "coupled", "fixed" and the like are used broadly, and may be, for example, a fixed connection, a detachable connection, or an integrated connection; may also be a mechanical or electrical connection; may also be a direct connections or indirect connection via an intervening structure; may also be an inner communication of two elements or a mutual interaction between two elements.

In the present disclosure, unless specified or limited otherwise, a structure in which a first feature is "on" or "below" a second feature may be an embodiment in which the first feature is in direct contact with the second feature, or an embodiment in which the first feature and the second feature are contacted indirectly via an intermediation. Furthermore, a first feature "on", "above" or "on top of" a second feature may be an embodiment in which the first feature is right or obliquely "on", "above" or "on top of" the second feature, or merely means that the first feature is at a height higher than that of the second feature; while a first feature "below", "under" or "on bottom of" a second feature may be an embodiment in which the first feature is right or obliquely "below", "under" or "on bottom of" the second feature, or merely means that the first feature is at a height lower than that of the second feature.

Reference throughout this specification to "an embodiment", "some embodiments", "one embodiment", "another example", "an example", "a specific example" or "some examples" means that a particular feature, structure, material, or characteristic described in connection with the embodiment or example is included in at least one embodiment or example of the present disclosure. Thus, the appearances of the phrases such as "in an embodiment", "in some embodiments", "in one embodiment", "in another example", "in an example", "in a specific example" or "in some examples" in various places throughout this specification are not necessarily referring to the same embodiment or example of the present disclosure. Furthermore, the particular features, structures, materials, or characteristics may be combined in any suitable manner in one or more embodiments or examples. In addition, different embodiments or examples and features in different embodiments or examples as described in this specification may be combined, without conflicting with each other.

What is claimed is:

1. A method for controlling an air conditioner, wherein the air conditioner comprises an outdoor heat exchanger, an indoor heat exchanger, a heat storage heat exchanger, a compressor, a four-way valve assembly, and a throttling assembly, the outdoor heat exchanger is connected to the indoor heat exchanger through either a first pipeline or a bypass, the outdoor heat exchanger is connected to the compressor through a second pipeline, the indoor heat exchanger is connected to the compressor through a third pipeline, wherein the heat storage heat exchanger is arranged at the bypass, the throttling assembly is arranged at the bypass, the four-way valve assembly comprises a first four-way valve and a second four-way valve, the first four-way valve is arranged at the second pipeline, the second four-way valve is arranged at the third pipeline, the method for controlling the air conditioner comprises:

identifying an operation mode of the air conditioner;

controlling the first four-way valve and the second four-way valve both to be electrified in response to the operation mode of the air conditioner being a heating mode; and controlling the first four-way valve to be unelectrified and the second four-way valve to be electrified in response to the operation mode of the air conditioner being a defrosting mode, controlling the outdoor heat exchanger and the indoor exchanger each serve as a condenser, controlling the heat storage heat exchanger converted from serving as a condenser to serving as an evaporator, and controlling heat absorbed from the heat storage heat exchanger for defrosting the outdoor heat exchanger.

2. The method according to claim 1, wherein after controlling the first four-way valve to be unelectrified and the second four-way valve to be electrified, the method further comprises:

controlling the first four-way valve and the second four-way valve both to be electrified, in response to identifying that the outdoor heat exchanger is of a first pipe-wall temperature higher than or equal to a first preset temperature and/or that a defrosting duration reaches a first preset duration.

3. The method according to claim 1, further comprising:

determining whether the air conditioner is in a target operation state, wherein the target operation state comprises a heating target operation state and a cooling target operation state; and controlling the throttling assembly to switch on in response to the air conditioner being in the target operation state, or controlling the throttling assembly to switch off in response to the air conditioner being out of the target operation state.

4. The method according to claim 3, wherein determining whether the air conditioner is in the target operation state comprises:

determining that the air conditioner is in the target operation state, in response to identifying that the air conditioner is of a heating capacity demand parameter or a cooling capacity demand parameter lower than or equal to a first preset threshold for a second preset duration; or determining that the air conditioner is out of the target operation state, in response to identifying that the air conditioner is of a heating capacity demand parameter or a cooling capacity demand parameter greater than or equal to a second preset threshold for a third preset duration.

5. The method according to claim 3, wherein the air conditioner comprises a plurality of the indoor heat exchangers, and determining whether the air conditioner is in the target operation state further comprises:

based on that the operation mode of the air conditioner is a mixed mode, wherein the mixed mode comprises the heating mode for at least one of the indoor heat exchangers and a cooling mode for at least one of the indoor heat exchangers, acquiring a heating capacity demand parameter and a cooling capacity demand parameter;

determining that the air conditioner is in the heating target operation state, in response to identifying that the heating capacity demand parameter is lower than or equal to the cooling capacity demand parameter, or determining that the air conditioner is in the cooling target operation state, in response to identifying that the heating capacity demand parameter is greater than the cooling capacity demand parameter.

6. The method according to claim 3, wherein prior to controlling the throttling assembly to switch on, the method further comprises:

identifying that the indoor heat exchanger is of a second pipe-wall temperature higher than or equal to a second preset temperature for a fourth preset duration in response to the air conditioner being in the heating target operation state; or identifying that the indoor heat exchanger is of a second pipe-wall temperature lower than or equal to a third preset temperature for a fifth preset duration in response to the air conditioner being in the cooling target operation state.

7. The method according to claim 3, wherein after controlling the throttling assembly to switch on, the method further comprises:

based on that the air conditioner is in the heating target operation state, controlling the first four-way valve to be powered off, in response to identifying that the heat storage heat exchanger is of an outlet pipe-wall temperature greater than or equal to a fourth preset temperature for a sixth preset duration; and controlling the first four-way valve to be powered on, and returning back to determine whether the air conditioner is in the target operation state and subsequent steps thereof, in response to identifying that the heat storage heat exchanger is of an inlet pipe-wall temperature lower than or equal to a fifth preset temperature and/or that the first four-way valve has been powered off for a seventh preset duration.

8. The method according to claim 3, wherein after controlling the throttling assembly to switch on, the method further comprises:

based on that the air conditioner is in the cooling target operation state, controlling the first four-way valve to be powered on, in response to identifying that the heat storage heat exchanger is of an outlet pipe-wall temperature lower than or equal to a sixth preset temperature for an eighth preset duration; and controlling the first four-way valve to be powered off, and returning back to determine whether the air conditioner is in the target operation state and subsequent steps thereof, in response to identifying that the heat storage heat exchanger is of an inlet pipe-wall temperature greater than or equal to a seventh preset temperature and/or that the first four-way valve has been powered on for a ninth preset duration.

9. The method according to claim 1, wherein the four-way valve assembly further comprises a third four-way valve arranged at the bypass, the method further comprises:

controlling the third four-way valve to be powered off in response to the operation mode of the air conditioner being the heating mode; and controlling the third four-way valve to be electrified in response to the operation mode of the air conditioner being the defrosting mode.

10. The method according to claim 9, further comprising:

controlling the first four-way valve and the second four-way valve both to be unelectrified, and the third four-way valve to be electrified, in response to the operation mode of the air conditioner being a cooling mode.

11. An electronic device, comprising a memory and a processor, wherein the processor runs a program corresponding to an executable program code by reading the executable program code stored in the memory, to implement a method for controlling an air conditioner of claim 1.

12. A non-transitory computer readable storage medium having stored therein a computer program that, when executed by a processor, implements a method for controlling an air conditioner of claim 1.

13. The non-transitory computer readable storage medium according to claim 12, wherein after controlling the first four-way valve to be unelectrified and the second four-way valve to be electrified, the method further comprises:

controlling the first four-way valve and the second four-way valve both to be electrified, in response to identifying that the outdoor heat exchanger is of a first pipe-wall temperature higher than or equal to a first preset temperature and/or that a defrosting duration reaches a first preset duration.

14. The non-transitory computer readable storage medium according to claim 12, further comprising:

determining whether the air conditioner is in a target operation state, wherein the target operation state comprises a heating target operation state and a cooling target operation state; and controlling the throttling assembly to switch on in response to the air conditioner being in the target operation state, or controlling the throttling assembly to switch off in response to the air conditioner being out of the target operation state.

15. The non-transitory computer readable storage medium according to claim 14, wherein determining whether the air conditioner is in the target operation state comprises:

determining that the air conditioner is in the target operation state, in response to identifying that the air conditioner is of a heating capacity demand parameter or a cooling capacity demand parameter lower than or equal to a first preset threshold for a second preset duration; or determining that the air conditioner is out of the target operation state, in response to identifying that the air conditioner is of a heating capacity demand parameter or a cooling capacity demand parameter greater than or equal to a second preset threshold for a third preset duration.

16. The non-transitory computer readable storage medium according to claim 14, wherein the air conditioner comprises a plurality of the indoor heat exchangers, and determining whether the air conditioner is in the target operation state further comprises:

based on that the operation mode of the air conditioner is a mixed mode, wherein the mixed mode comprises the heating mode for at least one of the indoor heat exchangers and a cooling mode for at least one of the indoor heat exchangers, acquiring a heating capacity demand parameter and a cooling capacity demand parameter;

determining that the air conditioner is in the heating target operation state, in response to identifying that the heating capacity demand parameter is lower than or equal to the cooling capacity demand parameter, or determining that the air conditioner is in the cooling target operation state, in response to identifying that the heating capacity demand parameter is greater than the cooling capacity demand parameter.

17. The non-transitory computer readable storage medium according to claim 14, wherein prior to controlling the throttling assembly to switch on, the method further comprises:

identifying that the indoor heat exchanger is of a second pipe-wall temperature higher than or equal to a second preset temperature for a fourth preset duration in response to the air conditioner being in the heating target operation state; or identifying that the indoor heat exchanger is of a second pipe-wall temperature lower than or equal to a third preset temperature for a fifth preset duration in response to the air conditioner being in the cooling target operation state.

* * * * *